US008739995B2

(12) United States Patent
Sasaki et al.

(10) Patent No.: US 8,739,995 B2
(45) Date of Patent: Jun. 3, 2014

(54) SYNTHETIC RESIN BOTTLE

(75) Inventors: Masaaki Sasaki, Tokyo (JP); Takayuki Kobayashi, Tokyo (JP); Tomoyuki Ozawa, Tokyo (JP); Takao Iizuka, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 286 days.

(21) Appl. No.: 11/990,980

(22) PCT Filed: Aug. 25, 2006

(86) PCT No.: PCT/JP2006/316686
§ 371 (c)(1),
(2), (4) Date: Feb. 26, 2008

(87) PCT Pub. No.: WO2007/026607
PCT Pub. Date: Mar. 8, 2007

(65) Prior Publication Data

US 2009/0289028 A1 Nov. 26, 2009

(30) Foreign Application Priority Data

| | | |
|---|---|---|
| Aug. 31, 2005 | (JP) | 2005-251756 |
| Dec. 27, 2005 | (JP) | 2005-374107 |
| Jan. 30, 2006 | (JP) | 2006-020853 |
| Mar. 30, 2006 | (JP) | 2006-094396 |
| Apr. 21, 2006 | (JP) | 2006-117674 |

(51) Int. Cl.
*B65D 1/02* (2006.01)

(52) U.S. Cl.
USPC ..... 215/384; 215/379; 215/381; 215/382; 215/383; D9/516; D9/520; D9/540; D9/541; D9/543

(58) Field of Classification Search
USPC ..... 215/379, 382, 383, 384
See application file for complete search history.

(56) References Cited

U.S. PATENT DOCUMENTS

| | | | | |
|---|---|---|---|---|
| 5,141,121 | A * | 8/1992 | Brown et al. | 215/381 |
| 5,226,550 | A * | 7/1993 | Mikolaitis et al. | 215/384 |

(Continued)

FOREIGN PATENT DOCUMENTS

| | | |
|---|---|---|
| EP | 1 459 990 A1 | 9/2004 |
| JP | U-61-117109 | 7/1986 |

(Continued)

OTHER PUBLICATIONS

Office Action dated Nov. 22, 2013 issued in U.S. Appl. No. 14/035,219.

*Primary Examiner* — Anthony Stashick
*Assistant Examiner* — Cynthia Collado
(74) *Attorney, Agent, or Firm* — Oliff PLC

(57) ABSTRACT

A technical problem of this invention especially in the case of large-size bottles is to form a grip, without changing the bottle shape to a large extent, so that the body can be firmly held. The object of this invention is to provide a synthetic resin square bottle that can be used reliably because the bottle can be held firmly with a hand. A major means of solving the problem is a synthetic resin square bottle comprising a body having a rectangular shape in a plane cross-section and a groove-like waist portion disposed at a middle height of the bottle, wherein a pair of recessed portions for use as finger stops are formed in respective long side walls of said rectangular body over a predetermined area ranging from said waist portion downward to ensure that a plural number of fingers can be placed in at least one recessed portion for a finger stop purpose, and wherein a grip for holding the bottle is formed from both the pair of recessed portions and the waist portion.

10 Claims, 23 Drawing Sheets

(56) References Cited

U.S. PATENT DOCUMENTS

| | | | | |
|---|---|---|---|---|
| 5,472,105 | A * | 12/1995 | Krishnakumar et al. | 215/384 |
| 6,016,932 | A * | 1/2000 | Gaydosh et al. | 215/382 |
| 6,349,839 | B1 | 2/2002 | Mooney | |
| 6,398,052 | B1 * | 6/2002 | Cheng et al. | 215/384 |
| D522,371 | S * | 6/2006 | Livingston | D9/538 |
| 7,097,060 | B2 * | 8/2006 | Penny et al. | 215/384 |
| 2001/0054597 | A1 | 12/2001 | Ozawa et al. | |
| 2003/0205550 | A1 * | 11/2003 | Prevot et al. | 215/384 |
| 2004/0134872 | A1 * | 7/2004 | Sasaki et al. | 215/384 |
| 2005/0040133 | A1 | 2/2005 | Saito et al. | |
| 2006/0180568 | A1 * | 8/2006 | Lane | 215/384 |
| 2008/0277374 | A1 * | 11/2008 | Miura | 215/384 |
| 2009/0159557 | A1 * | 6/2009 | De Vel et al. | 215/384 |
| 2010/0072168 | A1 * | 3/2010 | Kurihara et al. | 215/384 |

FOREIGN PATENT DOCUMENTS

| | | |
|---|---|---|
| JP | A-08-230856 | 9/1996 |
| JP | A-2002-145233 | 5/2002 |
| JP | A-2002-154517 | 5/2002 |
| JP | A-2002-326618 | 11/2002 |
| JP | A-2003-165518 | 6/2003 |
| JP | A-2003-527273 | 9/2003 |

* cited by examiner

Fig.2]

Fig.4
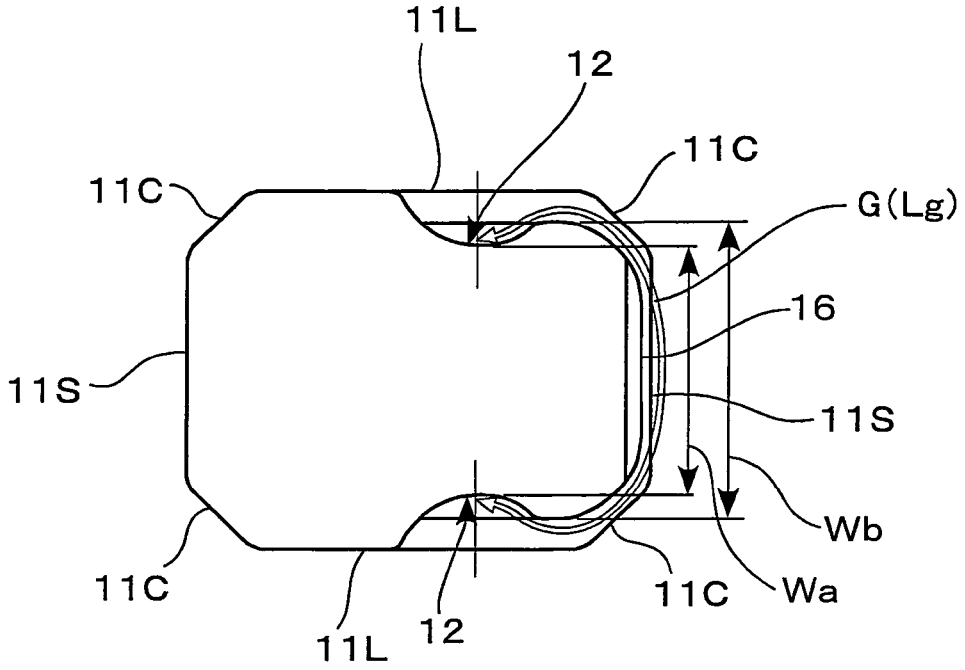
(a)
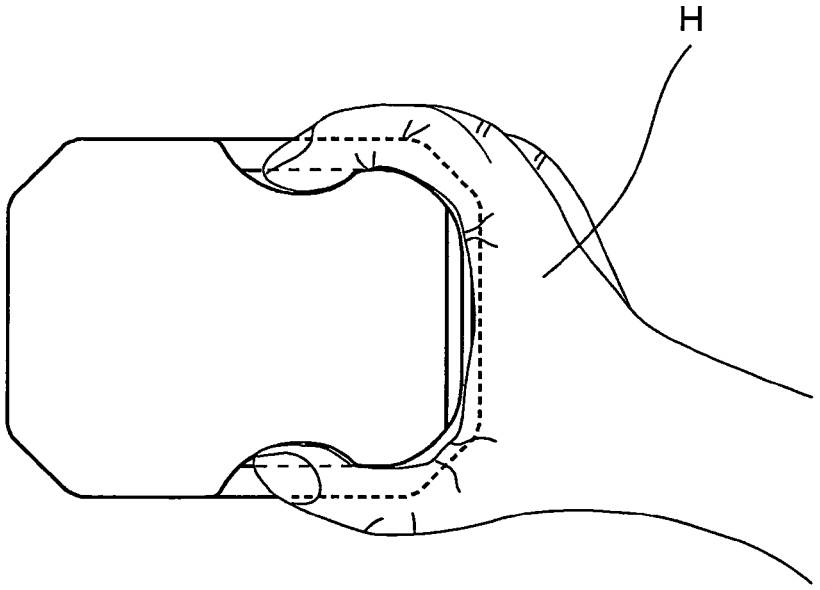
(b)

Fig.18
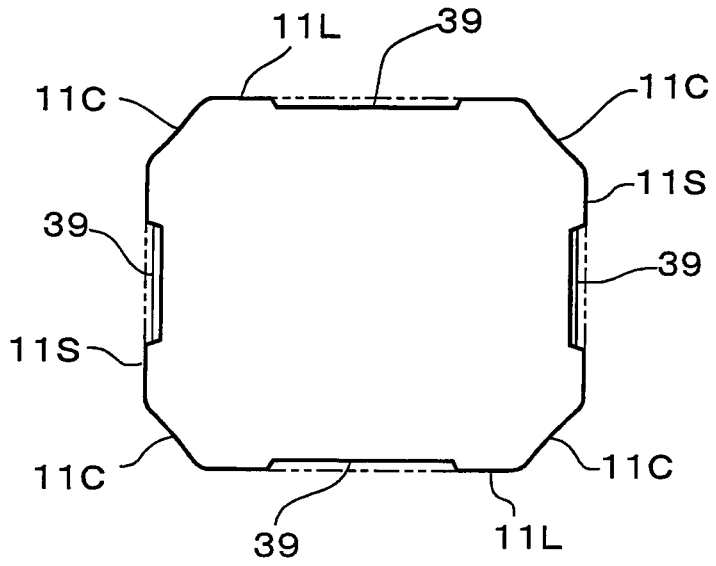
(a)
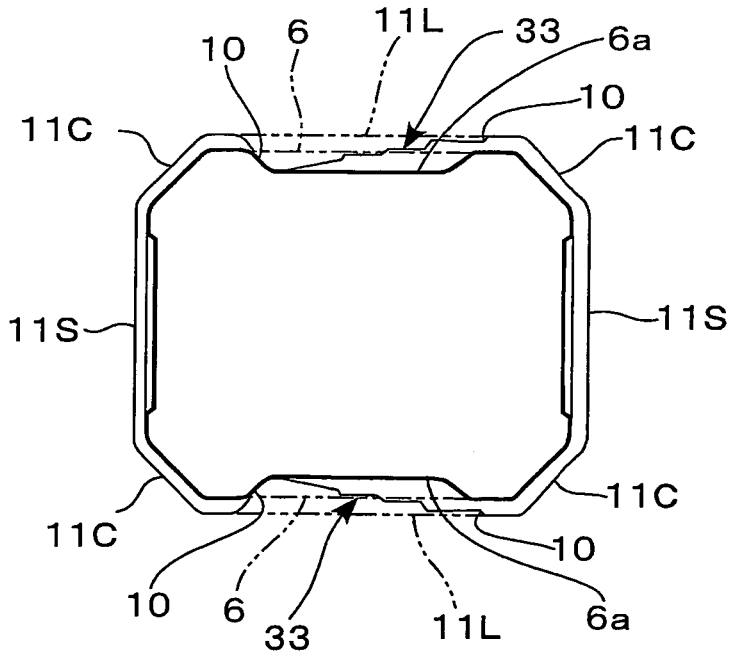
(b)

Fig.19
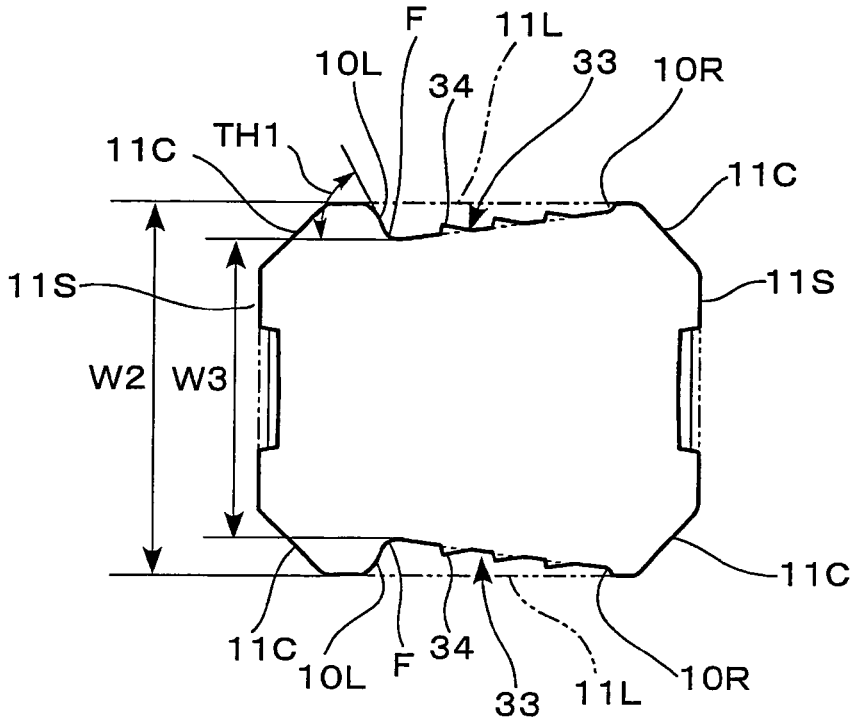
(a)
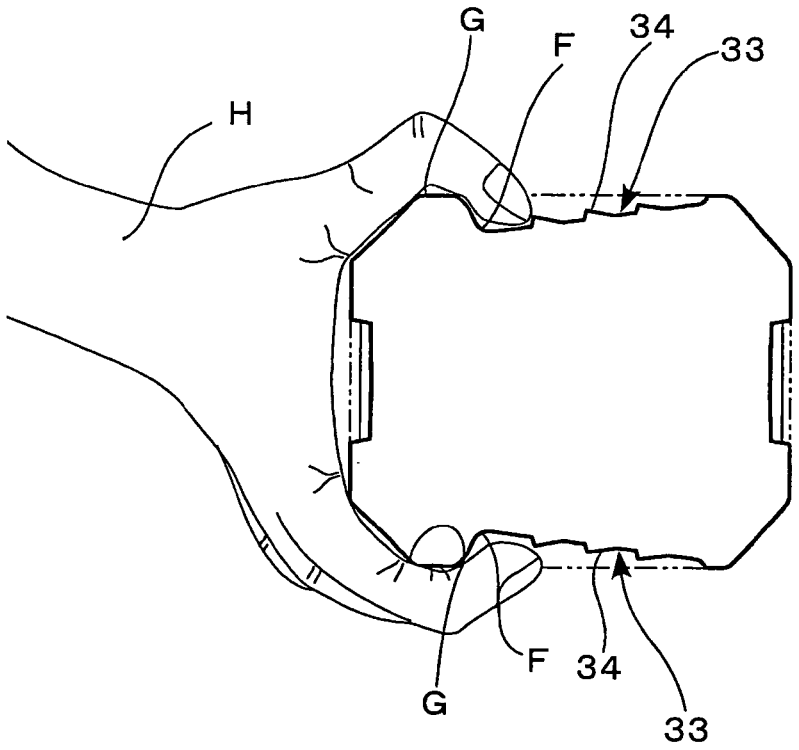
(b)

Fig.21
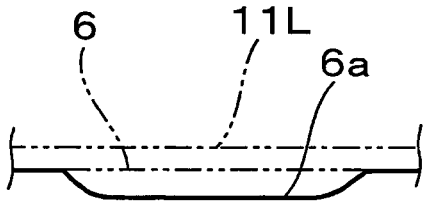
(a)
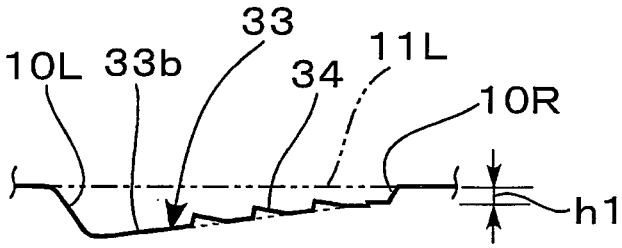
(b)

Fig.23
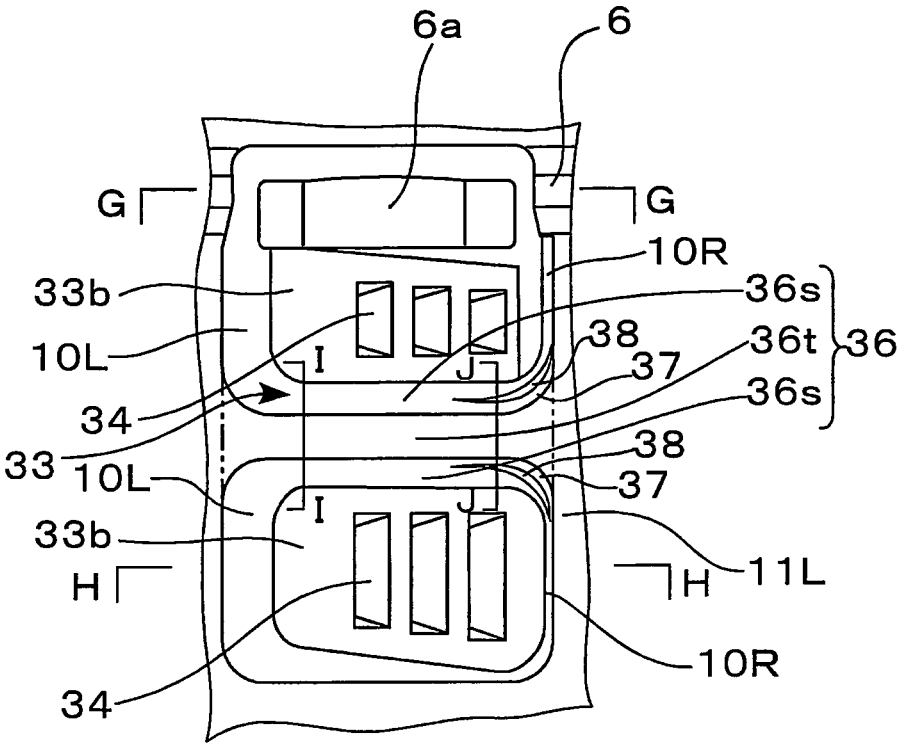
(a)
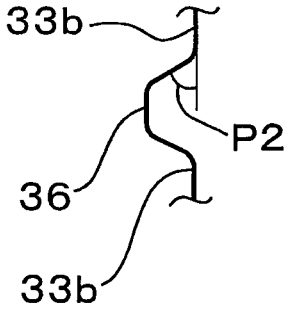
(b)
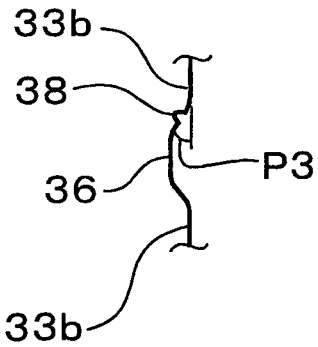
(c)

Fig.24
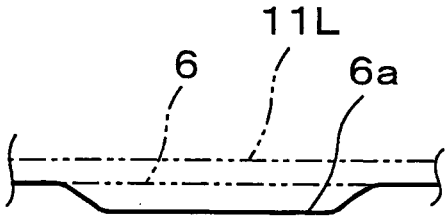
(a)
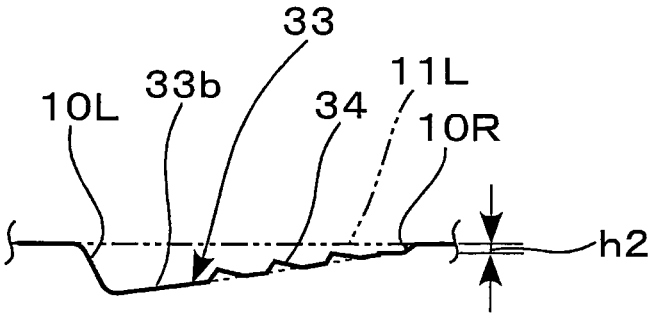
(b)

SYNTHETIC RESIN BOTTLE

TECHNICAL FIELD

This invention relates to a synthetic resin square bottle having a pair of recessed portions in the body walls for the purpose of providing finger stops.

Synthetic resin bottles made of polyethylene terephthalate resins (hereinafter referred to as PET resins) are widely in use as the containers for various drinks and foods. Bottles in a large size with a capacity of 2 L may be provided with a handle to hold the bottle firmly, depending on the purposes of use. In the case of square bottles, it is an ordinary method to form dents for use as finger stops in parts of the waist portion which is disposed at middle height of the body (See, for example, FIG. 1 of Patent Document 1).

[Patent Document 1] Published patent application JP2002-145233

DISCLOSURE OF THE INVENTION

Problems to be Solved by the Invention

Although the method of forming dents for use as finger stops in parts of the waist portion of a square bottle does not require a large change in the bottle shape, areas for forming dents are limited. These dents are formed only to an extent to which the thumb and the index finger of a hand are put in the corresponding dents that face each other. These dents cannot always afford the user to hold a bottle securely.

A technical problem of this invention especially in the case of large-size bottles is to form a grip, without changing the bottle shape to a large extent, so that the body can be firmly held. The object of this invention is to provide a synthetic resin square bottle that can be used reliably because the bottle can be held firmly with a hand.

The means of carrying out a first invention to solve the above-described problems is a synthetic resin square bottle comprising a body having a rectangular shape in a plane cross-section and a groove-like waist portion disposed at a middle height, wherein a pair of recessed portions for use as finger stops are formed in respective long side walls of the rectangular body over a predetermined height range from said waist portion downward to ensure that a plural number of fingers can be placed in at least one recessed portion for a finger stop purpose, and wherein a grip for holding the bottle is formed from both recessed portions and the waist portion.

Under the above construction of the first invention, the user can get firm hold of a bottle by putting the tip of the thumb in the waist portion of one long side wall, while putting the tip of the index finger in the waist portion of the other long side wall, and in addition, putting the tips of the middle finger and the ring finger, or the tips of the middle finger, the ring finger, and the little finger, in a recessed portion. Thus, even in the case where the bottle is filled with the contents and weighs heavy, the user can carry the bottle with a hand or tilt the bottle to pour the contents from the neck because the body can be held with an entire hand including all fingers and the palm.

The means of carrying out a second invention comprises that, in the first invention, the recessed portions are formed in a state in which the upper end area thereof is connected integrally to the waist portion. The grip for grasping the bottle is formed from both recessed portions and the rear wall portion between the two recessed portions, while the grip is also connected integrally to the waist portion.

Under the above-described construction of the second invention, the user can carry a bottle in one hand or holds and tilts the bottle to pour the contents from the mouth of the bottle, while putting the thumb in one recessed portion, putting other fingers in the other recessed portion, and getting firm hold of the grip with entire palm and fingers.

The recessed portions for putting the thumb and fingers therein are formed in a state in which the upper end area thereof is connected integrally to the waist portion. The grip for grasping the bottle is formed from both recessed portions and the rear wall portion between the two recessed portions, and is also connected integrally to the waist portion. As a result, the user can get hold of the bottle securely by placing inner sides of the thumb and the index finger in the groove-like waist portion so as to lock the roughly entire length of these sides ranging from the thumb to the index finger.

Thus, the grip is configured by utilizing the already existing waist portion and by being integrally connected thereto. Because the existing waist portion is utilized, the grip including the recessed portions can be formed without making the wall shape complicated and without giving large damage to the rigidity or buckling strength of the bottle. The upper half of the body above the waist portion may be wrapped with a shrink label.

The means of carrying out a third invention comprises that, in the second invention, the body comprises a pair of long side walls of a rectangular body, a pair of short side walls of the same rectangular body, and four corner walls connecting a long side wall to an adjacent short side wall in a chamfered manner.

Under the construction of the third invention, four corner walls are disposed so as to perform a function of pillars that support the bottle. Because of these corner walls, the bottle can retain high levels of rigidity and buckling strength. The grip is configured by utilizing these corner walls. The user can grasp the body of the bottle by applying bases of the thumb and fingers to the corner walls.

The means of carrying out a fourth invention comprises that, in the second or third invention, a side wall sandwiched between one recessed portion and the other recessed portion is recessed stepwise so as to form a rear wall portion over a predetermined height range from the waist portion downward, and wherein the grip thus comprises both recessed portions and the rear wall portion.

When the rear wall portion is formed in such a way under the construction of the fourth invention, the user can grasp the grip and get hold of the bottle securely with a hand, by allowing the side of the palm, including the sides of fingers ranging from the tip of the thumb to the tip of the index finger, to come in contact the waist portion for firm grasping of the grip. The depth of the grooves in the rear wall portion and the height range are matters of design that can be determined, taking bottle size, palm size, and appearance into consideration.

The means of carrying out a fifth invention comprises that, in the second, third or fourth invention, a lateral raised rib is formed in each recessed portion to reinforce the recessed portion and to stabilize the state of fingers placed inside the recessed portion away from the waist portion.

In the cases of bottles having relatively large recessed portions, such as the bottle of this invention, an impact from a fall of the bottle filled with the contents and sealed may cause reversible deformation (buckling) in the central part of the recessed portions. Under the above construction of the fifth invention, the raised rib formed laterally in the recessed portion can effectively prevent buckling from occurring.

When the user gets hold of a bottle by placing the thumb and fingers in the recessed portions, the user can maintain the finger stop state more stably by fitting the tips of the thumb and the index finger in the space between the waist portion and this raised rib. Especially, the raised rib in each recessed portion has a downward anti-slip function for the finger tips. In pouring the contents, for example, the user can get stable hold of the bottle even if the bottle is inclined to a nearly inverted position.

The number and position of raised rib can be determined by taking into account the reinforcing effect on buckling and the easiness to put the thumb and fingers in the recessed portions.

The means of carrying out a sixth invention comprises that, in the second, third, fourth or fifth invention, a reinforcing rib to reinforce each recessed portion is transversely formed inside the recessed portion.

Under the above construction of the sixth invention, the reinforcing ribs enable the recessed portions to perform a full reinforcing effect associated with buckling. Reinforcing ribs are classified into ridge-like raised reinforcing ribs and groove-like dented reinforcing ribs. In the case where a plural number of raised ribs are used for each recessed portion, finger positioning can be clarified as much as in the case of a single raised rib. However, the users sometimes may feel bothersome in fitting the fingers in the corresponding recessed portion, because there are individual physical differences, such as the finger size. In this respect, dented reinforcing ribs allow the user to put finger tips in the recessed portion automatically, although the dented reinforcing ribs have a low finger stop effect.

It is preferred that a raised reinforcing rib or ribs is/are combined appropriately with a dented reinforcing rib or ribs by giving consideration to the buckling-associated reinforcing function, the finger stop function, the finger positioning function of the recessed portion, as well as easiness for fingers to enter the recessed portions. Of course, it is possible to use only a raised reinforcing rib or ribs or only a grooved reinforcing rib or ribs.

The means of carrying out a seventh invention comprises that, in the fourth, fifth or sixth invention, lateral width at the bases of both recessed portions is in a range of 55 to 70 mm, and lateral width at or near upper end of the rear wall portion is in a range of 70 to 80 mm.

Under the above construction of the seventh invention, these levels of width determine the shape of the grip, taking average size of palm of ordinary people into consideration. If users grasp the grip of this invention to get hold of the bottle, they usually support the load with the thumb tip and the tips of other fingers. The width as measured at the bases of both recessed portions is a measurement concerned with a span between the thumb tip and the tips of other fingers. The width as measured near the upper end of the rear wall portion is a measurement concerned with the span between thumb base and the bases of other fingers. A good grip is obtained for many users by specifying the levels of width in the respective ranges.

The means of carrying out an eighth invention comprises that, in the fourth, fifth, sixth or seventh invention, the grip, starting from one recessed portion and ending at the other recessed portion by way of the rear wall portion, has a peripheral length in a range of 140 to 180 mm.

Under the above construction of the eighth invention, a grip shape, too, is determined by giving consideration to an average size of the palm of ordinary people. The peripheral length of this grip is determined by giving consideration to a length from the tip of the thumb to the tip of the index finger, as measured along the sides of both fingers and the curve between the thumb and the index finger. A good grip is obtained for many users by specifying the level of this measurement in the range described above.

The means of carrying out a ninth invention comprises that, in the fourth, fifth, sixth, seventh or eighth invention, the rear wall portion is formed in such a way that lateral width thereof widens downward.

Under the above construction of the ninth invention, it would become easy for the user to get hold of a bottle if the rear wall portion is formed in such a way that lateral width thereof widens downward. The buckling strength is also improved.

The means of carrying out a tenth invention comprises that, in the fourth, fifth, sixth, seventh, eighth or ninth invention, the rear wall portion is provided with lateral ribs extending to the right and the left.

Under the above construction of the tenth invention, lateral ribs extending to the right and the left prevent the rear wall portion from being distorted and deformed abnormally by the grasping force acting on the grip, or prevent the contents from bursting out due to the deformation of the rear wall portion.

The means of carrying out an $11^{th}$ invention comprises that, in the second, third, fourth, fifth, sixth, seventh, eighth, ninth or tenth invention, a vacuum-absorbing panel is formed below the waist portion of each long side wall in such a way that the panel is connected to a recessed portion.

Heat resistant bottles used in applications requiring a hot filling step are provided with flat or dented vacuum-absorbing panels disposed in the body walls, with each panel being surrounded peripherally by a slope. Under the above construction of the $11^{th}$ invention, the vacuum-absorbing function can be fully performed over a wide area containing the recessed portions because the vacuum-absorbing panels are integrally connected to the recessed portions for putting the thumb and fingers therein.

The means of carrying out a $12^{th}$ invention comprises that, in the first invention, vacuum-absorbing panels are formed in long side walls in a recessed state, surrounded by a slope, and are used as recessed portions.

The above-described construction of the $12^{th}$ invention is used in applications requiring hot filling, such as various drinks and foods, and is applied to synthetic resin bottles having vacuum-absorbing panels disposed in the body wall to absorb deformation of the bottle under a reduced pressure condition in an inconspicuous way from an appearance point of view. It is also intended to utilize these vacuum-absorbing panels to secure firm grip of the bottle.

Under the above-described construction of the $12^{th}$ invention, a grip is formed by utilizing vacuum-absorbing panels. There is no need to form a grip newly, and the grip can be formed without any large change in the shape of the bottle. In the case of large-size bottles, the vacuum-absorbing panels are also of a large size. A bottle can be held with a hand by placing the thumb on one vacuum-absorbing panel and the rest of the fingers on the opposed vacuum-absorbing panel. Depending on the remaining volume of the contents, the user can pick out a suitable position of the grip by changing the height of grip within the vacuum-absorbing panels.

The means of carrying out a $13^{th}$ invention comprises that, in the $12^{th}$ invention, vertical raised ribs are disposed in each vacuum-absorbing panel.

Under the above construction of the $13^{th}$ invention, the vertical raised ribs help the deformation of vacuum-absorbing panels to be kept constant so that bottle appearance cannot be spoiled at the time of pressure reduction. The raised ribs also provide a finger stop function for the user to hold the bottle firmly. Only one vertical raised rib is sufficient, or multiple ribs may be disposed in rows, taking into account the way the body walls deform at the time of pressure reduction or the performance of the grip.

The means of carrying out a $14^{th}$ invention comprises that, in the $13^{th}$ invention, the vacuum-absorbing panels have an average depth of dent ranging from 3% to 15% of short-side width of the rectangular body.

Under the above-described construction of the $14^{th}$ invention, the grip can exercise full performance without giving damage to the appearance of square bottles, while securing a sufficient capacity if the vacuum-absorbing panels have an average depth of dent ranging from 3% to 15% of short-side width of the rectangular body.

The means of carrying out a $15^{th}$ invention comprises that, in the $13^{th}$ or $14^{th}$ invention, vertical raised ribs are disposed in a segmentalized state.

Under the above-described construction of the $15^{th}$ invention, the vertical raised ribs disposed in a segmentalized state can help the vacuum-absorbing panels retain normal cave-in deformability at the time of pressure reduction.

The means of carrying out a $16^{th}$ invention comprises that, in the $15^{th}$ invention, a rib-free space between segments of vertical raised ribs has a longitudinal length corresponding to 30% or less of longitudinal length of each vacuum-absorbing panel.

Under the above-described construction of the $16^{th}$ invention, this rib-free space can fulfill the finger stop function if the longitudinal length of this space is set at a level corresponding to 30% or less of the longitudinal length of each vacuum-absorbing panel.

The means of carrying out a $17^{th}$ invention comprises that, in the $13^{th}$, $14^{th}$, $15^{th}$ or $16^{th}$ invention, each vacuum-absorbing panel is shifted from horizontal center of a corresponding long side wall.

Sometimes, there may occur inconveniences, such as a case where tips of the thumb and fingers fail to reach the vacuum-absorbing panels. However, in that case, firm grip of the bottle can be obtained under the above-described construction of the $17^{th}$ invention, by shifting the panels from the horizontal center of the respective long side walls toward the right or the left, taking the gripping function into consideration.

The means of carrying out an $18^{th}$ invention comprises that, in the $13^{th}$, $14^{th}$, $15^{th}$, $16^{th}$ or $17^{th}$ invention, finger stops are formed by increasing depth of dents at or near either right or left ends of the vacuum-absorbing panels.

Under the above-described construction of the $18^{th}$ invention, a deep dent at one end is used as a finger stop. By putting the thumb and fingers of a hand in the deep dents, the user can get firm hold of the bottle stably.

The means of carrying out a $19^{th}$ invention comprises that, in the $18^{th}$ invention, width between foots of corresponding slopes, from which a pair of finger stops is formed, is in a range of 50% to 90% of short-side width of the rectangular body, that each finger stop has a steep slope angle in a range of 30 to 90 degrees, and that the vacuum-absorbing panels have a gentle slope angle of 9 degrees or less, as measured against the long side wall, when the depth of dents for the vacuum absorbing panels is increased linearly from either right or left end to the other end.

The above-described construction of the $19^{th}$ invention is concerned with the shape of the finger stops. The width between foots of corresponding slopes, from which a pair of finger stops is formed, the steep slope angle of each finger stop, and the gentle slope angle of the vacuum-absorbing panels are as specified in the $18^{th}$ invention. Because of these dimensions, the square bottle of this invention is provided with a pair of finger stops for firm grip of the bottle, even if the bottle has a large size, while giving no damage to appearance and securing a necessary capacity.

The means of carrying out a $20^{th}$ invention comprises that, in the $13^{th}$, $14^{th}$, $15^{th}$, $16^{th}$, $17^{th}$, $18^{th}$ or $19^{th}$ invention, a multitude of lateral ribs are disposed in a pair of short side walls of the rectangular body.

Under the above-described construction of the $20^{th}$ invention, a multitude of lateral ribs disposed in a pair of short side walls increase surface rigidity of these walls. If the user holds a bottle with a hand from both sides of a pair of vacuum-absorbing panels disposed in a pair of long side walls, the body would not be flattened out, but remain stably held, with no contents bursting out.

The means of carrying out a $21^{st}$ invention comprises that, in the $13^{th}$, $14^{th}$, $15^{th}$, $16^{th}$, $17^{th}$, $18^{th}$, $19^{th}$ or $20^{th}$ invention, the body comprises a pair of long side walls, a pair of short side walls, and four corner walls connecting an adjacent long side wall to an adjacent short side wall in a chamfered manner.

Under the above-described construction of the $21^{st}$ invention, the corner walls give a highly rigid square bottle.

The means of carrying out a $22^{nd}$ invention comprises that, in the $13^{th}$, $14^{th}$, $15^{th}$, $16^{th}$, $17^{th}$, $18^{th}$, $19^{th}$, $20^{th}$ or $21^{st}$ invention, each vacuum-absorbing panel has an area in a range of 30% to 90% of area of a long side wall disposed below the waist portion in which the vacuum-absorbing panel is disposed.

Under the above-described construction of the $22^{nd}$ invention, a larger area of the vacuum-absorbing panel than specified in the $22^{nd}$ invention gives damage to bottle rigidity, and a smaller area of the panel than specified gives damage to the vacuum-absorbing function, and cannot fully secure the area for grip. A panel area in a range of 30% to 90% of the long side wall area below the waist portion allows the bottle to perform the vacuum-absorbing function fully without giving damage to bottle rigidity and to secure sufficient areas for the grip.

The means of carrying out a $23^{rd}$ invention comprises that, in the $13^{th}$, $14^{th}$, $15^{th}$, $16^{th}$, $17^{th}$, $18^{th}$, $19^{th}$, $20^{th}$, $21^{st}$ or $22^{nd}$ invention, the vacuum-absorbing panels are disposed in such a way that upper edge portions are integrated with the waist portion.

Under the above-described construction of the $23^{rd}$ invention, the user can hold the bottle in a state in which a part of the thumb and fingers are caught in the waist portion, allowing the user to get hold of the bottle more stably.

The means of carrying out a $24^{th}$ invention comprises that, in the $13^{th}$, $14^{th}$, $15^{th}$, $16^{th}$, $17^{th}$, $18^{th}$, $19^{th}$, $20^{th}$, $21^{st}$, $22^{nd}$ or $23^{rd}$ invention, a lateral recessed zone is formed in each vacuum-absorbing panel for the purpose of being used as a finger stop.

Under the above-described construction of the $24^{th}$ invention, the user can stably get hold of the bottle in an upright, inverted, or inclined bottle position, by putting the tips of the fingers in the lateral recessed zone.

The means of carrying out a $25^{th}$ invention comprises that, in the $24^{th}$ invention, the vacuum-absorbing panels are disposed below the waist portion in such a way that upper edge portions are integrated with the waist portion and wherein the lateral recessed zone is formed over entire width of each vacuum-absorbing panel.

Under the above-described construction of the $25^{th}$ invention, the bottle in an upright, inverted, or inclined position can be held more securely and stably, for example, by putting the tip of the thumb in the waist portion integrated with one vacuum-absorbing panel, putting the tip of the index finger in the corresponding waist portion integrated with the other vacuum-absorbing panel, and in addition, putting the middle finger and/or the ring finger in the corresponding lateral recessed zone.

The means of carrying out a 26th invention comprises that, in the 12th invention, an embanked lateral rib is formed at a predetermined height position of each vacuum-absorbing panel by building an embankment that rises outward from recessed surface of the panel and transversely crosses the panel.

If vacuum-absorbing panels are configured for use as the grip, the dents of the vacuum-absorbing panels are much deepened to get sufficient hold of the bottle. In that case, the vacuum-absorbing panels tend to be reversed and widely swollen outward with an increase in internal pressure at the time of pressurized filling of the contents. However, because of a constructive requirement in the 26th invention, "an embanked lateral rib formed at a predetermined height position of the vacuum-absorbing panels by building an embankment that rises outward from recessed surface of the panel and transversely crosses each panel," it is possible to control effectively the deformation of vacuum-absorbing panels into a swollen state, which occurs with an increase in internal pressure at the time of a filling operation.

By fixing fingertips appropriately to this embanked lateral rib, the user can prevent the bottle from slipping off in the vertical direction and get stable hold of the bottle at any upright, inverted, or inclined bottle position.

The position of each vacuum-absorbing panel in the long side walls is not limited to horizontal center of the corresponding wall, but can be shifted from the center either toward the right or the left, taking the width of the bottle body into consideration from a point of view of getting firm hold of the bottle. Width, height, and cross-sectional shape of the embanked lateral rib, and its height position in a vacuum-absorbing panel are matters of design, which can be determined suitably, taking the vacuum-absorbing function into consideration. These factors have many variations. The embanked lateral rib is not limited to one for a panel, but a plural number of embanked lateral ribs can be formed, depending on the grasping situation.

The means of carrying out a 27th invention comprises that, in the 26th invention, vacuum-absorbing panels are formed in such a way that upper end areas thereof are integrally connected to the waist portion.

Under the above construction of the 27th invention, the grasping function and the vacuum-absorbing function can be performed in large areas by connecting the upper end of the vacuum-absorbing panels integrally to the waist portion. The user can lock fingers in the waist portion by utilizing its groove-like shape and get hold of a bottle stably at a height position closer to the center of gravity.

The means of carrying out a 28th invention comprises that, in the 27th invention, the vacuum-absorbing panels are disposed in such a way that upper end areas thereof are integrally connected to the waist portion and wherein lateral groove of the waist portion is further caved inward at areas connected to the vacuum-absorbing panels to form lateral deep holes for use as finger stops.

Under the above construction of the 28th invention, a part of fingers can be put in the lateral deep holes formed in the waist portion for singer stop use. The user can get hold of a bottle more stably than ever at various bottle positions, including an upright, inverted, or inclined position, for example, by putting the tip of the thumb in the waist portion of one long side wall from underside, while putting the tip of the index finger in the waist portion of the other long side wall, and in addition, putting the tips of the middle finger, the ring finger, and the little finger in the vacuum-absorbing panel disposed in the other long side wall, so that these three fingers can be fixed to the embanked lateral rib either from upside or the downside.

The means of carrying out a 29th invention comprises that, in the 26th, 27th or 28th invention, the embanked lateral rib comprises a top flat surface and a pair of banks that connect this top flat surface to the recessed surfaces at a predetermined slope angle and that the top flat surface is on the same plane as the long side wall.

The above construction of the 29th invention is concerned with a specific shape of the embanked lateral rib. Given a sufficient height, the embanked lateral rib can fully perform the function of controlling swollen deformation and the finger locking function in the vertical direction, which is enabled by utilizing the banks. If large vacuum-absorbing panels were formed in the side walls, bottle guides on the filling line would be limited to the heel portion in the lower area of the body. Since the top flat surface of each embanked lateral rib is on the same plane as the corresponding long side wall, not only the heel portion but also this top flat surface can be utilized as a guide on the production line.

The means of carrying out a 30th invention comprises that, in the 26th, 27th, 28th or 29th invention, the vacuum-absorbing panels have an average depth of dent ranging from 3% to 15% of short-side width of a rectangular body.

Under the above construction of the 30th invention, the bottle can be held firmly without giving damage to the appearance of square bottles and the line adaptability, while securing a sufficient capacity, because the vacuum-absorbing panels have an average depth of dent specified in the range of 3% to 15% of short-side width of the rectangular body.

The means of carrying out a 31st invention comprises that, in the 26th, 27th, 28th, 29th or 30th invention, a finger stop is formed by increasing the depth of dent at or near either right or left end of each vacuum-absorbing panel.

Under the above construction of the 31st invention, each dent deepened at one end is used as a finger stop. By putting the thumb and fingers of a hand in the deep dents caved in both long side walls, the user can get firm hold of the bottle stably.

The means of carrying out the invention of the 32nd invention comprises that, in the 31st invention, the width between foots of corresponding slopes, from which a pair of finger stops is formed, is in a range of 60% to 95% of short-side width of the rectangular body and that each slope used as a finger stop has a steep slope angle in a range of 30 to 90 degrees.

The above construction of the 32nd invention is concerned with the guidance in designing the shape of finger stops. The width between foots of corresponding slopes, from which a pair of finger stops is formed, and the steep slope angle of each slope used as a finger stop are as specified in the 32nd invention. Because of these specified dimensions, the square bottle of this invention is provided with a pair of finger stops for firm grasp of the bottle, while giving no damage to appearance and securing a necessary capacity, even if the bottle is of a large size.

The means of carrying out a 33rd invention comprises that, in the 26th, 27th, 28th, 29th, 30th, 31st, 32nd or 33rd invention, the depth of recessed surfaces of the vacuum-absorbing panels is decreased gradually from either right or left end toward the other end.

It is intended in the case of the bottle of this invention that the vacuum-absorbing panels are also used as the grip to hold the bottle firmly. For this purpose, it is necessary for these panels to be recessed backward so that the slopes are relatively steep. However, the long side walls lying next to the slopes or the areas ranging from the long side walls to the corner walls tend to experience buckling deformation into a reversed state, when the bottle is put under reduced pressure, when the bottle is held with a hand, or when the long side walls surrounding the vacuum-absorbing panels are accidentally pushed with fingers.

Under the above construction the 33rd invention, the depth of recessed surfaces of the vacuum-absorbing panels is decreased gradually from either right or left end toward the other end. At one end, the slope is steep so as to ensure that the bottle can be held firmly. In contrast, at the other end of each recessed surface, the slope is gentle enough to smoothly carry forward the depressurization-induced deformation from the vacuum-absorbing panels to an adjacent long side wall area by way of this low-angle slope. Thus, this long side wall area, too, performs the vacuum-absorbing function, and on the whole, a larger vacuum-absorbing function can be achieved. As a result, it becomes possible to prevent above-described buckling deformation involved in the deformation caused by a reduced pressure. Such construction of the 33rd invention can also control the buckling deformation that occurs when a user happens to push the long side walls that surrounds a vacuum-absorbing panel. Deformation can be carried forward smoothly by setting a small angle for the gentle slope.

The means of carrying out invention 34th invention comprises that, in the 33rd invention, the embanked lateral rib comprises the top flat surface and the banks that connect this top flat surface to the recessed surfaces, that the top flat surface is on the same plane as the long side wall, and that the angle of gradient of the banks is gradually changed from either right or left end of a vacuum-absorbing panel, where the depth of dent is largest, to the other shallow end so as to give the shallow end a low angle of gradient.

Under the above construction of the 34th invention, the banks on both sides of the embanked lateral rib are formed so as to have a small angle of gradient and become low in height at either right or left end of each recessed surface. Because of this shallow end with the banks having a low slope angle, the deformation caused by a reduced pressure can be effectively and smoothly carried forward from the vacuum-absorbing panels to the adjacent long side wall areas.

The means of carrying out a 35th invention comprises that, in the 33rd or 34th invention, the deformation of the vacuum-absorbing panels into a dented state, which occurs at the time of increased depressurization inside the bottle, is carried forward in a recoverable manner to a surrounding area, starting from the deformation at either right or left end of the embanked lateral rib disposed on the shallow side of the recessed surface of each vacuum-absorbing panel (hereinafter referred to as the rib end on the shallow side).

Both ends of the embanked lateral rib are where this rib butts against the panel-surrounding slopes on both sides of the recessed surfaces in a T-shaped configuration. Under the above construction the 35th invention, the slope and the rib at the rib end on the shallow side are made low in height.

Because the embanked lateral rib and the slope are low in height at the end on the shallow side, this rib end can be prone to inflection and deformation into a dented state. When there is an increase in the depressurization inside the bottle, the deformation into a dented state is carried forward in a recoverable manner to a surrounding area, starting preferentially from the deformation at the rib end on the shallow side. In addition, even if the deformation is carried forward to a surrounding area, the bottle appearance is not damaged to a large extent, and all in all, a very good vacuum-absorbing function is performed.

The means of carrying out a 36th invention comprises that, in the 33rd, 34th or 35th invention, at the time when the user gets hold of the body by putting the thumb and fingers on the vacuum-absorbing panels so as to squeeze the body, the resultant deformation of the vacuum-absorbing panels into a dented state is carried forward in a recoverable manner to surrounding areas, starting from the deformation at either right or left end of the embanked lateral rib disposed on the shallow side of the recessed surface of each vacuum-absorbing panel.

Under the above construction of the 36th invention, it can be made easy to inflect the end of the embanked lateral rib on the shallow side and to deform this rib end into the dented state in a manner similar to the case of internal depressurization. Therefore, when the user gets hold of the body by putting the thumb and fingers on the vacuum-absorbing panels, the resultant deformation can be carried forward in a recoverable manner to a surrounding area, starting preferentially from the deformation at this rib end on the shallow side.

Based on the deformation into a dented state going on in the above-described manner, the end of the embanked lateral rib on the shallow side is preferentially inflected and dented when the user gets hold of the body by putting the thumb and fingers on the vacuum-absorbing panels so as to squeeze the body. Since the deformation starting from this rib end on the shallow side is smoothly carried forward to a surrounding area, any distorted deformation can be effectively controlled in other portions of the body, and there is no large damage to the appearance of the bottle.

Likewise, based on the deformation going on in the above-described manner, the embanked lateral rib, a nearby slope, and an adjacent flat wall portion are deformed into a dented state according to the squeeze with the fingers in contact with respective portions. Therefore, when the user gets hold of the body from the direction of the rib end on the shallow side, the body of the bottle well fits in with the palm of the hand with which the bottle is held.

The means of carrying out a 37th invention comprises that, in the 26th, 27th, 28th, 29th, 30th, 31st, 32nd, 33rd, 34th, 35th or 36th invention, the recessed surfaces of the vacuum-absorbing panels are provided with ridge segments having an anti-slip function to prevent slips in the lateral direction.

Under the above construction of the 37th invention, the ridge segments perform the anti-slip function in the lateral direction for the bottle-grasping fingers. These ridge segments may have various types including vertical ridge segments, vertical grooves, stepwise projections, or recessed portions and can be used appropriately for the same purpose.

Effects of the Invention

This invention having the above construction has the following effects: According to the first invention, the user can get firm hold of a bottle by putting the tip of the thumb in the waist portion of one long side wall, while putting the tip of the index finger in the waist portion of the other long side wall, and in addition, putting the tips of the middle finger and the ring finger, or the tips of the middle finger, the ring finger, and the little finger, in a recessed portion. Thus, even in the case where the bottle is filled with the contents and weighs heavy, the user can carry the bottle with a hand or tilt the bottle to pour the contents from the mouth because the body can be held with an entire hand including all fingers and the palm.

According to the second invention, the recessed portions for putting the thumb and fingers therein are formed in a state in which the upper end portion thereof is integrally connected to the waist portion. The grip for grasping the bottle is formed from both recessed portions and the rear wall portion disposed between the two recessed portions, and is integrally connected to the waist portion. As a result, the user can get hold of the bottle securely by interlocking the inner sides of the thumb and the index finger with the waist portion along the roughly entire length of these thumb and finger.

Thus, the grip is configured by being connected to the already existing waist portion. Because the existing waist portion is utilized, the grip including the recessed portions can be formed without making wall shape complicated and without giving large damage to the rigidity or buckling strength of the bottle.

According to the third invention, the bottle can retain high levels of rigidity and buckling strength because the corner walls fulfill a function of pillars that support the bottle. The grip is configured by utilizing these corner walls. The user can grasp the body of the bottle with a hand more securely than ever.

When the side wall is recessed stepwise to form a rear wall portion over a predetermined height range from the upper end of the waist portion downward according to the fourth invention, the user can grasp the grip and get hold of the bottle securely with a hand, by allowing the side of the palm and the sides of fingers ranging from the tip of the thumb to the tip of the index finger to come in contact the waist portion and interlocking the fingers with the grip.

According to the fifth invention, the raised rib formed transversely in each recessed portion can effectively prevent buckling from occurring. The user can maintain the finger stop state stably by fitting the tips of the thumb and the index finger in the space between the waist portion and this raised rib.

According to the sixth invention, the reinforcing ribs enable the recessed portions to show a full reinforcing effect against buckling.

According to the seventh invention, a good grip is obtained for many users by specifying the lateral width at the bases of both recessed portions in a range of 55 to 70 mm and the lateral width at or near the upper end of the rear wall portion in a range of 70 to 80 mm.

According to the eighth invention, a good grip is obtained for many users by specifying the peripheral length of the grip in a range of 140 to 180 mm.

According to the ninth invention, it would become easy for the users to get hold of a bottle if the rear wall portion is formed in such a way that lateral width thereof widens downward. The buckling strength is also improved.

According to the tenth invention, lateral ribs extending to the right and the left prevent the rear wall portion from being distorted and deformed abnormally by the grasping force acting on the grip, or prevent the contents from bursting out due to the deformation of the rear wall portion.

According to the $11^{th}$ invention, the vacuum-absorbing panels are integrally connected to the recessed portions for putting fingers therein. Thus, the vacuum-absorbing function can be fully performed over a wide area including the recessed portions According to the $12^{th}$ invention, the grip is formed by utilizing vacuum-absorbing panels. There is no need to form a grip newly, and the grip can be formed without any large change in the shape of the bottle. In the case of large-size bottles, large areas can be utilized for the vacuum-absorbing panels. The user can get hold of the bottle with an entire hand by putting the thumb on one vacuum-absorbing panel and putting the remaining fingers on the other vacuum-absorbing panel. Depending on the remaining volume of the contents, the user can pick out a suitable position of the grip by shifting the gripping position of the hand within the vacuum-absorbing panels.

According to the $13^{th}$ invention, the vertical raised ribs help the deformation of vacuum-absorbing panels to be kept constant so that bottle appearance cannot be spoiled at the time of pressure reduction. The raised ribs also provide a finger stop function for getting firm hold of the bottle.

According to the $14^{th}$ invention, the grip can exercise full performance without giving damage to the appearance of square bottles, while securing a sufficient capacity, provided that the vacuum-absorbing panels have an average depth of dents ranging from 3% to 15% of short-side width of the rectangular body.

According to the $15^{th}$ invention, the vertical raised ribs disposed in a segmentalized state can help the vacuum-absorbing panels retain normal cave-in deformability at the time of pressure reduction.

According to the $16^{th}$ invention, the rib-free space between segments of vertical raised ribs can fulfill the finger stop function sufficiently if the longitudinal length of this space is set at a level corresponding to 30% or less of the longitudinal length of each vacuum-absorbing panel.

According to the $17^{th}$ invention, firm grip of the bottle can be obtained by shifting the panels from the horizontal center of the respective flat walls toward the right or the left, taking the grip function into consideration, if necessary.

According to the $18^{th}$ invention, a deep dent at one end is used as a finger stop. By putting the thumb and fingers of a hand in the dents, the user can get firm hold of the bottle stably.

The above-described construction of the $19^{th}$ invention is concerned with the shape of the finger stops. According to the $19^{th}$ invention, the width between foots of corresponding slopes, from which a pair of finger stops is formed, the steep slope angle of each finger stop, and the gentle slope angle of the vacuum-absorbing panels are as specified in the $19^{th}$ invention. Because of these dimensions, the square bottle of this invention can be provided with a pair of finger stops for firm grip of the bottle, even if the bottle is of a large size, while giving no damage to appearance, securing a necessary capacity, and fulfilling the vacuum-absorbing function sufficiently.

According to the $20^{th}$ invention, a multitude of lateral ribs is disposed in a pair of short side walls. If the user holds a bottle with a hand from both sides of a pair of vacuum-absorbing panels, the body would not be flattened out, but remain stably held, with no contents bursting out.

According to the $21^{st}$ invention, the corner walls and the waist portion give a highly rigid square bottle.

According to the $22^{nd}$ invention, a vacuum-absorbing panel area specified in a range of 30% to 90% of the flat wall area below the waist portion allows the bottle to perform fully the vacuum-absorbing function without giving damage to bottle rigidity and to secure sufficient areas for the grip.

According to the $23^{rd}$ invention, the user can hold the bottle in a state in which a part of the thumb and fingers are caught in the waist portion, allowing the user to hold the bottle more stably by preventing vertical slip of the bottle.

According to the $24^{th}$ invention, the user can stably get hold of the bottle in an upright, inverted, or inclined bottle position, by putting the tips of fingers in a lateral recessed zone.

According to the $25^{th}$ invention, the bottle in an upright, inverted, or inclined position can be held more securely and stably, for example, by putting the tip of the thumb in the waist portion integrated with one vacuum-absorbing panel, putting the tip of the index finger in the corresponding waist portion integrated with the other vacuum-absorbing panel, and in addition, putting the middle finger and/or the ring finger in the corresponding lateral recessed zone.

According to the $26^{th}$ invention, the embanked lateral rib is formed so as to cross each vacuum-absorbing panel. As such, it performs the function of preventing the corresponding vacuum-absorbing panel from being reversed in the other way and deformed into a swollen state that often occurs during the period when the bottles are filled with the contents under a pressurized condition. The rib is also effective in vertically locking the fingers of the hand with which the bottle is held.

According to the 27$^{th}$ invention, the grasping function and the vacuum-absorbing function can be performed in larger areas by connecting the upper end of the vacuum-absorbing panels integrally to the waist portion. The user can lock fingers in the waist portion by utilizing its groove-like shape and get hold of a bottle stably at a height position closer to the center of gravity.

According to the 28$^{th}$ invention, a part of fingers can be put in the lateral deep holes formed in the waist portion for finger stop use. The user can get hold of a bottle more stably than ever at various bottle positions.

According to the 29$^{th}$ invention, the embanked lateral rib with a sufficient height can fully perform the function of controlling swollen deformation and the finger locking function to prevent the slips in the vertical direction by utilizing the banks. Since the top flat surface of each embanked lateral rib is on the same plane as the corresponding flat wall, not only the heel portion but also this top flat surface can also be utilized as the guide on the production line.

According to the 30$^{th}$ invention, the bottle can be held firmly without giving damage to the appearance of square bottles, while securing a sufficient capacity, because the vacuum-absorbing panels have an average depth of dent specified in the range of 3% to 15% of short-side width of the rectangular body.

According to the 31$^{st}$ invention, each dent deepened at one end is used as a finger stop. By putting the thumb and fingers of a hand in the deep dents caved in both flat walls, the user can get firm hold of the bottle stably.

The above construction of the 32$^{nd}$ invention is concerned with the guidance in designing the shape of finger stops. The width between foots of corresponding slopes, from which a pair of finger stops is formed, and the steep slope angle of each finger stop are as specified in the 32$^{nd}$ invention. Because of these specified dimensions, the square bottle of this invention is provided with a pair of finger stops for firm hold of the bottle, while giving no damage to appearance and securing a necessary capacity, even if the bottle is of a large size.

According to the 33$^{rd}$ invention, the slope is steep at the right or left end so as to ensure that the bottle can be held firmly. In contrast, at the other end of each recessed surface, the slope is gentle and short enough to smoothly carry forward the depressurization-induced deformation from the vacuum-absorbing panels to an adjacent flat wall area by way of this low-angle slope. As a result, it becomes possible to prevent above-described buckling deformation involved in the deformation caused by a reduced pressure.

According to the 34$^{th}$ invention, the banks on both sides of the embanked lateral rib are formed so as to have a small angle of gradient and become low in height at either right or left end of each recessed surface. Thus, the deformation caused by a reduced pressure can be effectively and smoothly carried forward from the vacuum-absorbing panels to the adjacent flat wall areas.

According to the 35$^{th}$ invention, the end of the embanked lateral rib on the shallow side can be made prone to inflection and deformation into a dented state. When there is an increase in the depressurization inside the bottle, the deformation into a dented state is carried forward in a recoverable manner to a surrounding area, starting preferentially from the deformation at the rib end on the shallow side. In addition, even if the deformation is carried forward to the surrounding area, the bottle appearance is not damaged to a large extent, and all in all, a very good vacuum-absorbing function is performed.

According to the 36$^{th}$ invention, the end of the embanked lateral rib on the shallow side is preferentially inflected and dented when the user gets hold of the body by putting the thumb and fingers on the vacuum-absorbing panels. Since the deformation starting from this rib end on the shallow side is smoothly carried forward to a surrounding area, any distorted deformation into a dented state can be effectively controlled in other portions of the body, and there is no large damage to the appearance of the bottle.

According to the 37$^{th}$ invention, the ridge segments perform the anti-slip function in the lateral direction for the bottle-grasping fingers.

BRIEF DESCRIPTION OF THE DRAWINGS

FIG. 4(*a*) is a plane cross-sectional view of the body, taken from line A-A shown in FIG. 1 and FIG. 4(*b*) is an explanatory diagram showing a hand grasping the grip.

FIG. 14(*b*) is a plane cross-sectional view taken from line C-C in FIG. 12.

FIGS. 18(*a*) and 18(*b*) are plane cross-sectional views of the body taken from lines A-A and B-B, respectively, in FIG. 16.

FIG. 19(*a*) is a plane cross-sectional view of the body taken from line C-C in FIG. 16, and FIG. 19(*b*) is an explanatory diagram showing a hand with which the bottle is held.

FIGS. 21(*a*) and 21(*b*) are plane cross-sectional views taken from lines D-D and E-E, respectively, in FIG. 16.

FIG. 23(*a*) is an enlarged front view of the vacuum-absorbing panel of the bottle in the sixth embodiment of this invention. FIGS. 23(*b*) and 23(*c*) are vertical sections taken from lines I-I and J-J, respectively, in FIG. 23(*a*).

FIGS. 24(*a*) and 24(*b*) are plane cross-sectional views taken from lines G-G and H-H, respectively, in FIG. 23(*a*).

EXPLANATION OF CODES

Figure 1:
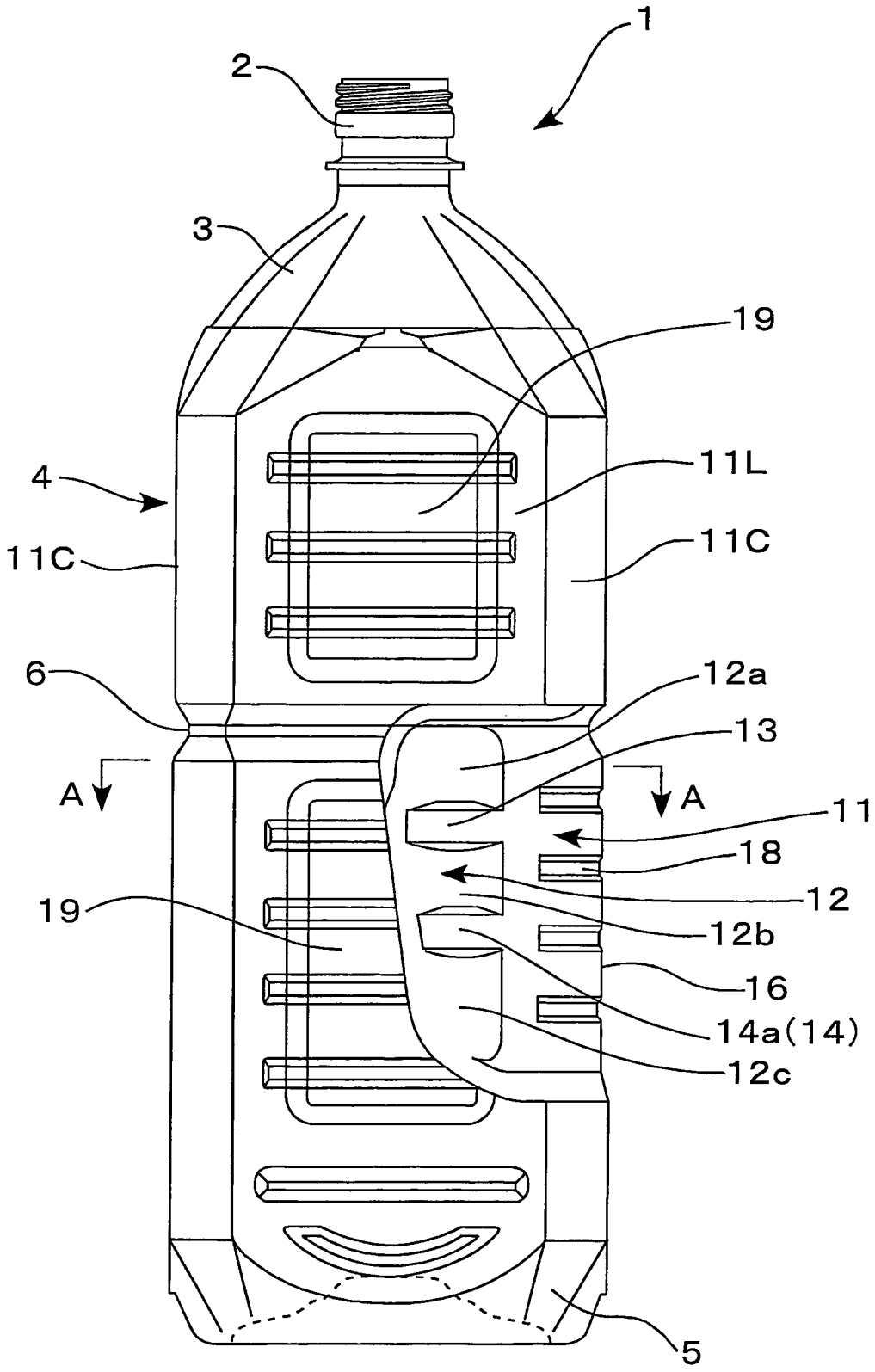
FIG. 1 is a side elevational view of the bottle in a first embodiment of this invention.

1. Bottle
2. Neck
3. Shoulder
4. Body
5. Bottom
6. Waist portion
6*a*. Lateral deep hole in the waist portion
10 (10L, 10R). Slope
11. Side wall
11L. Long side wall
11S. Short side wall
11C. Corner wall
12. Recessed portion
12*a*, 12*b*, 12*c*. Small dent
13. Lateral raised rib
14. Reinforcing rib
14*a*. Raised reinforcing rib
14*b*. Grooved reinforcing rib
16. Rear wall portion
18. Lateral rib
19. Vacuum-absorbing panel
23. Vacuum-absorbing panel
24. Vertical raised rib
24*a*. Rib-free space
26. Lateral recessed zone
28. Lateral rib
29. Vacuum-absorbing panel
33. Vacuum-absorbing panel
33*b*. Recessed surface
34. Ridge segment
36. Embanked lateral rib
36*t*. Top flat surface
36*s*. Bank
37. Corner
38. Crescent ridge
39. Vacuum-absorbing panel
Wa. Lateral width of recessed portions at their bases
Wb. Lateral width of the rear wall portion
Lg. Peripheral length of the grip
G. Grip
H. Hand
F. Finger stop
L1, L2. Length
W1, W2, W3. Width
Dave. Average depth of dent
TH1, TH2. Angle
S1. Area
P1, P2, P3. Rising slope angle
h1, h2. Slope height
E (ER, EL). End of embanked lateral rib
R. Area of deformation into a dented state

PREFERRED EMBODIMENTS OF THE INVENTION

Figure 2:
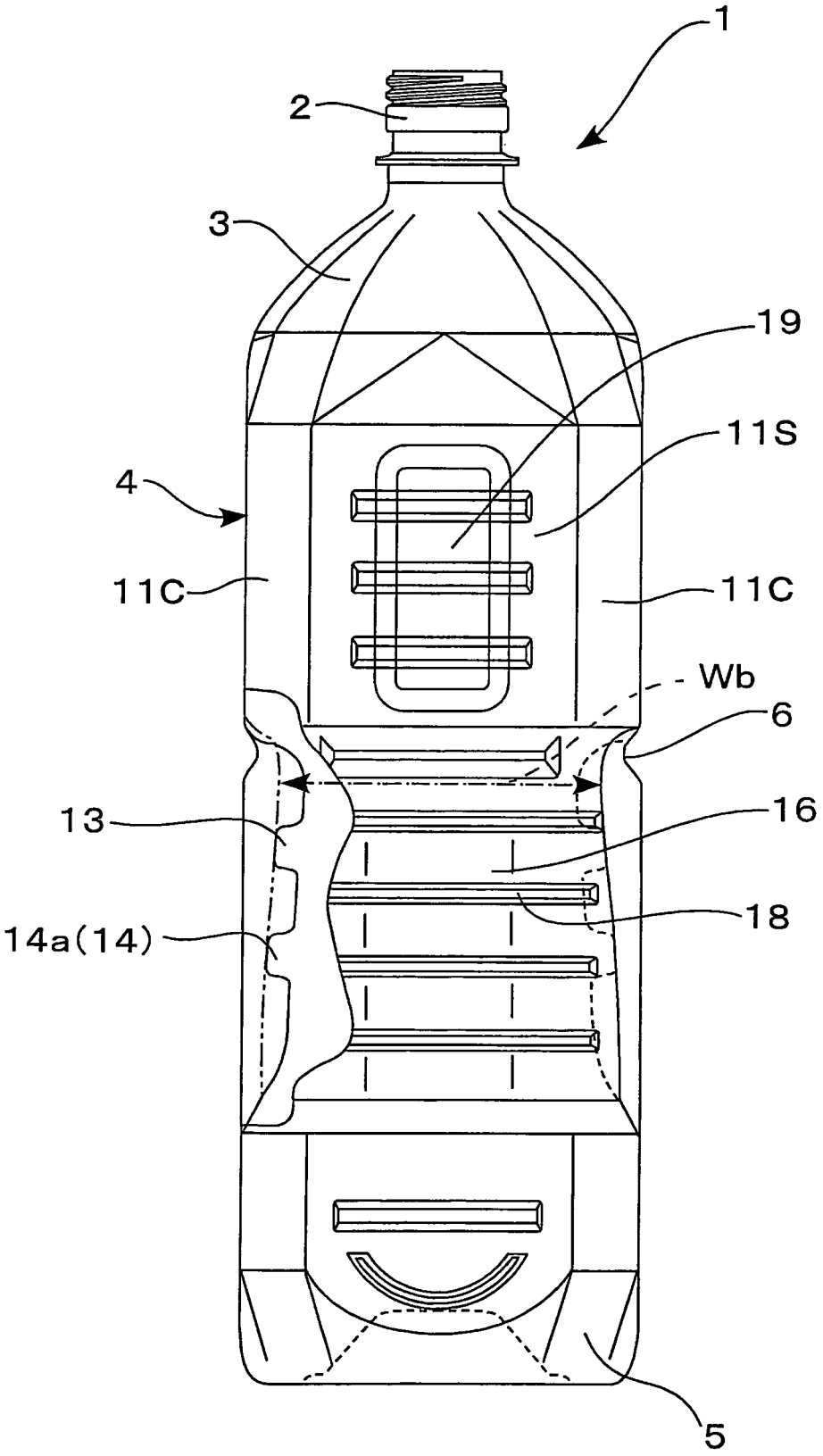
FIG. 2 is a rear elevation of the bottle shown in FIG. 1.
Figure 3:
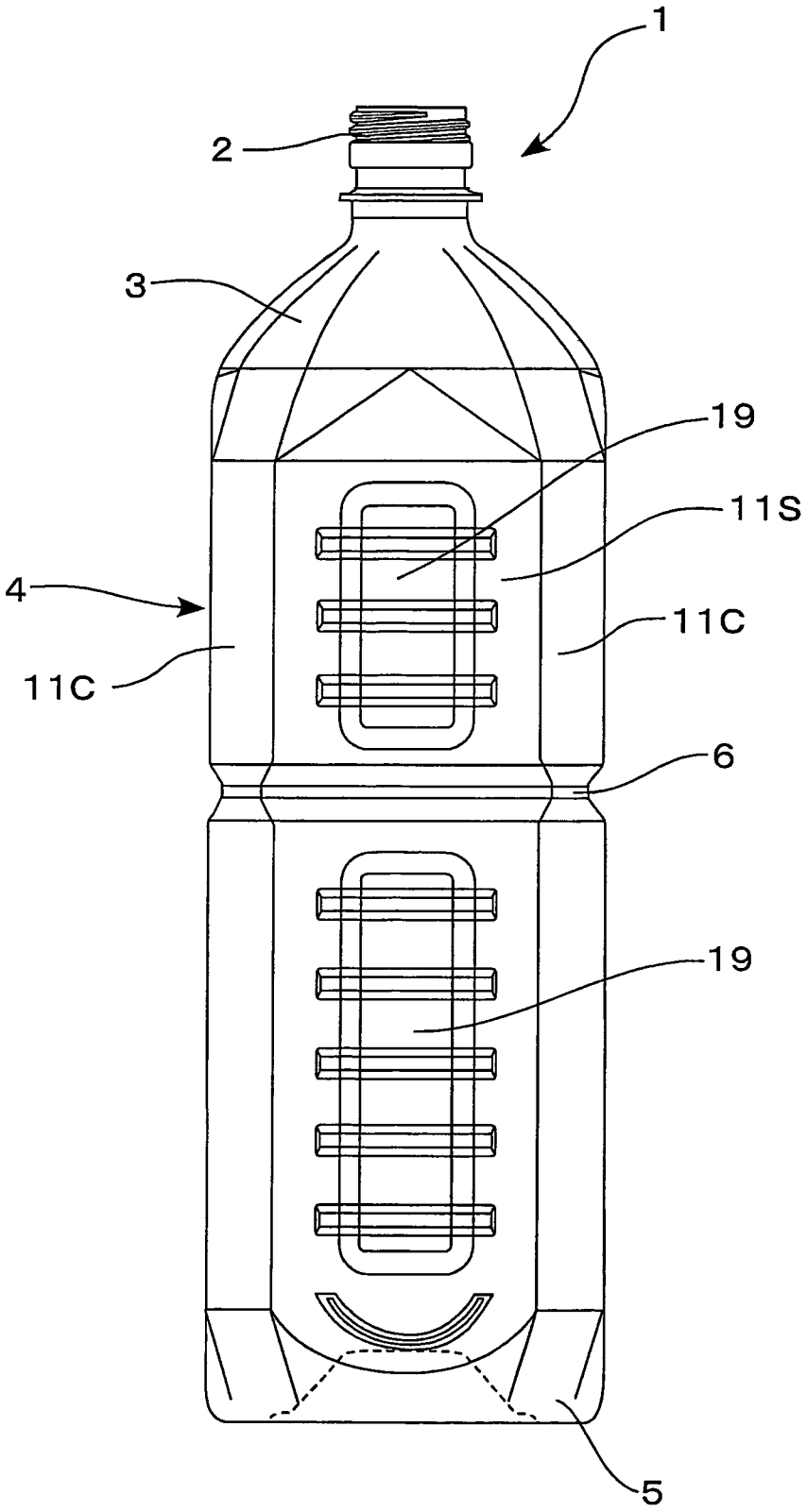
FIG. 3 is a front elevational view of the bottle shown in FIG. 1.

This invention is further described with respect to the embodiments, now referring to the drawings. FIGS. 1-4 show the synthetic resin square bottle in a first embodiment of the invention. FIG. 1 is a side elevational view; FIG. 2, a rear elevation; FIG. 3, a front elevational view, FIG. 4(*a*), a cross-sectional view taken from line A-A in FIG. 1, and FIG. 4(*b*), an explanatory diagram showing the bottle grasped with a hand. This bottle 1 is a biaxially drawn, blow molded product made of a PET resin, and comprises a neck 2, a shoulder 3, a body 4, and a bottom 8. It is a square bottle having a nominal capacity of 2 L.

The body 4 has a roughly rectangular cross-section (See FIG. 4(*a*)), and comprises a pair of long side walls 11L that form the long sides of a rectangle, a pair of short side walls 11S that form the short sides of the rectangle, and four corner walls 11C that connect a long side wall 11L to an adjacent short side wall 11S in a chamfered manner. The body 4 also comprises a waist portion 6 in the shape of a peripheral groove, which is disposed at an almost middle height of the body 4 to increase the rigidity of the bottle 1.

A pair of vertically long recessed portions 12 are formed in the long side walls 11L over a height range from the waist portion downward and at positions facing each other, but a little rearward from both long side walls 11L (right side in FIG. 1). A side wall 11 sandwiched between one recessed portion 12 and the other recessed portion 12 is recessed stepwise so as to form a rear wall portion 16 over a predetermined height range from upper end of the waist portion 6 downward. The grip G comprises both recessed portions 12 and the rear wall portion 16 (See outline arrow in FIG. 4(*a*)).

Inside each recessed portion 12, a lateral raised rib 13 and a raised reinforcing rib 14*a* are transversely disposed. The latter reinforcing rib 14*a* is a type of reinforcing ribs 14 and is disposed below the raised rib 13. These two ribs divide the recessed portion into small dents 12*a*, 12*b*, and 12*c*. The raised rib 13 and the raised reinforcing rib 14*a* perform a finger-positioning function in grasping the grip, a finger stop function that prevents the bottle from slipping off from the hand, and a reinforcing function that prevents the recessed portions 12 from buckling.

The rear wall portion 16 is provided with a plural number of lateral ribs 18 extending to the right and the left (four ribs in this embodiment). These ribs prevent the rear wall portion 16 from being distorted and deformed abnormally by the grasping force acting on the grip G, or prevent the contents from bursting out due to the deformation of the rear wall portion 16. The rear wall portion 16 is formed in such a way that lateral width thereof widens downward. Therefore, it should be easy for the user to grasp the grip, and in addition, buckling strength is improved.

Vacuum-absorbing panels 19 are formed in areas above and below the waist portion 6 in the long side walls 11L and below the waist portion 6 in the short side walls 11S. In the areas below the waist portion 6, the vacuum-absorbing panels 19 are formed by being connected integrally to respective recessed portions 12, so that the recessed portions 12 would never give damage to the vacuum-absorbing function of these panels 19. In this way, it is ensured that the vacuum-absorbing function is performed in large areas including respective recessed portions 12.

The square bottle in this embodiment has the following sizes, areas, and angles specified for various portions of the bottle:

Bottle height: 305 mm

Lateral long-side width of the body 4: 106 mm: and short-side width: 90 mm

Lateral width Wa at the bases of both recessed portions: 62 mm

Lateral width Wb at the upper end of the rear wall portion 16: 73 mm

Peripheral length Lg of the grip 16: 145 mm

For Wa, Wb, and Lg, refer to FIG. 4(*a*).

In getting hold of the bottle 1 in this embodiment, the user can put the tip of the thumb of a hand in the small dent 12*a* of one recessed portion 12, while in the other recessed portion 12, putting the tip of the index finger in the other small dent 12*a* of the other recessed portion 12, the tip of the middle finger in the small dent 12*b*, and the tips of the ring finger and the little finger in the small dent 12*c* of the other recessed portion 12 (See FIG. 1 and FIGS. 4(*a*), (*b*)).

As shown in FIG. 4(*b*), the user can get hold of the bottle securely by grasping the grip G. When the user clenches his/her first around the grip, the inner tip-to-base sides of the thumb and the index finger come in contact with the waist portion 6 from underside, and the fingers are interlocked firmly with the grip. In this state, the bottle 1 can be prevented reliably from slipping off from the hand; or the fingers, from sliding upward from the grip. The raised ribs 13 and the raised reinforcing ribs 14*a* can effectively prevent the bottle 1 from moving from the grasp or slipping out of the hand. When the user inclines the bottle 1 up to an almost inverted position to pour the contents, it is still possible for the user to get stable hold of the bottle with a hand. Naturally, it should be understood here that positioning of the fingers among the small dents 12*a*, 12*b*, and 12*c* is not limited to that described above. Depending on the situation in which to use the bottle, the user is at liberty to select any finger positions consciously or mechanically.

Figure 5:
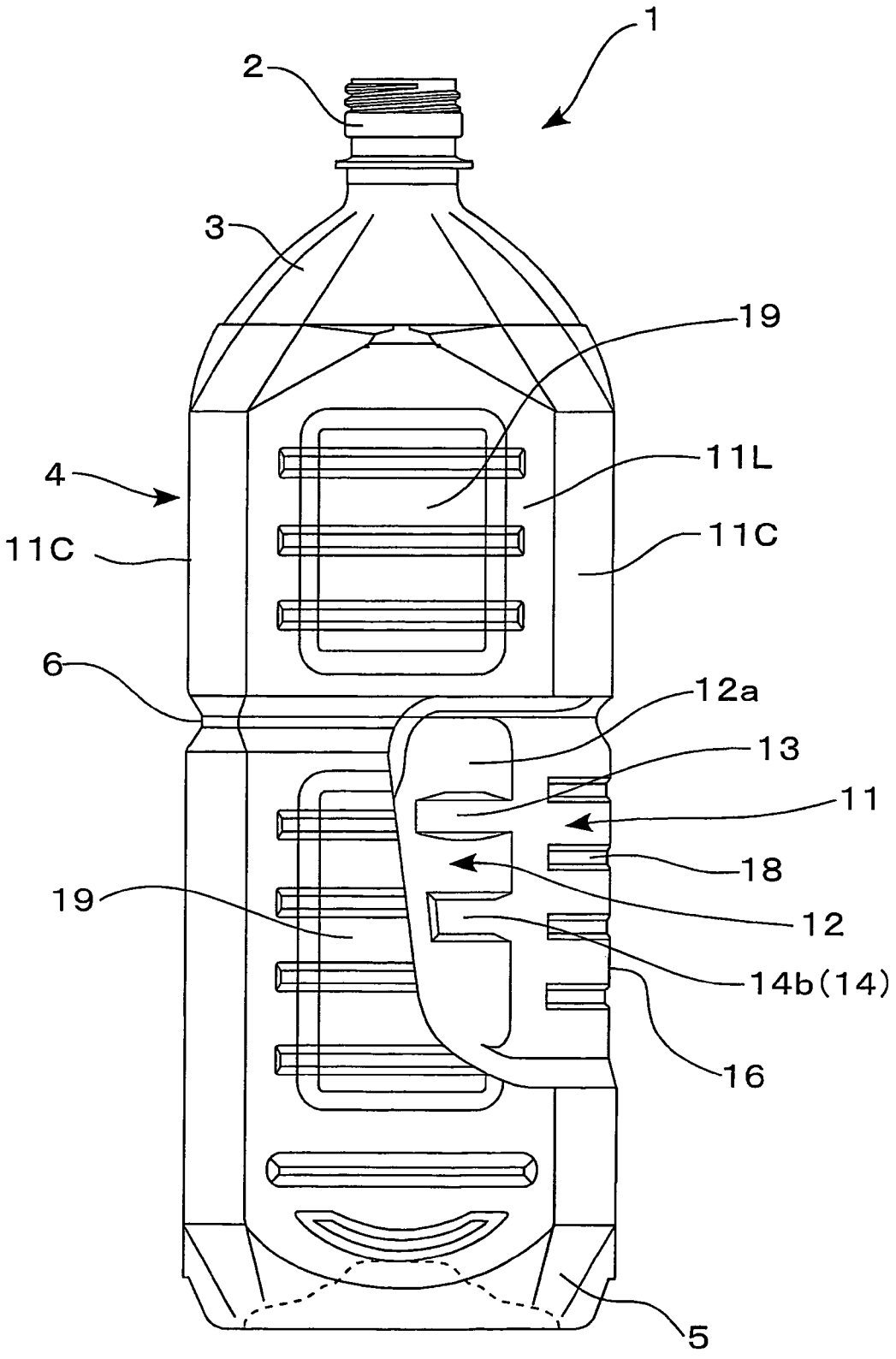
FIG. 5 is a side elevational view of the bottle in a second embodiment of this invention.
Figure 6:
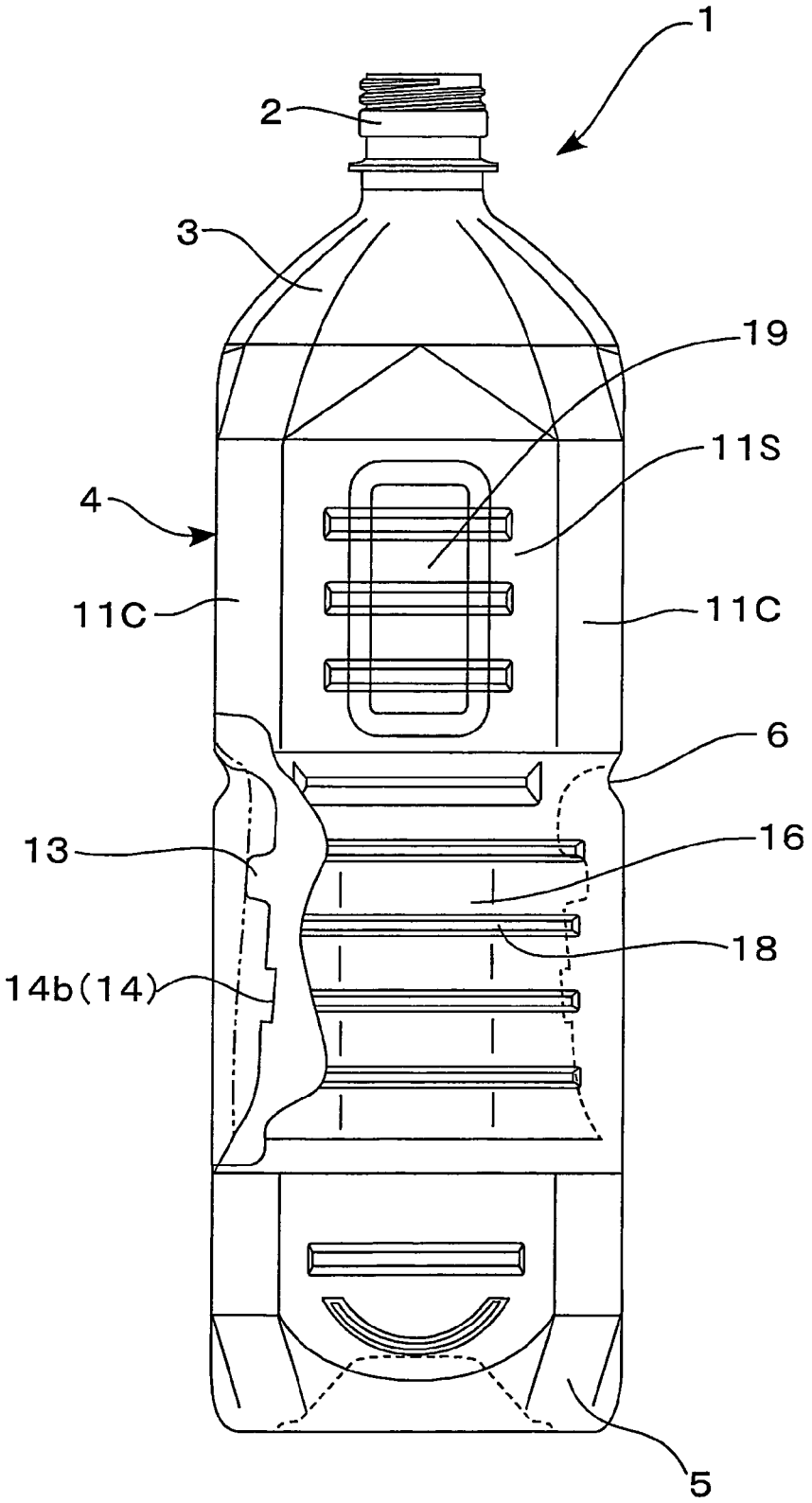
FIG. 6 is a rear elevation of the bottle shown in FIG. 5.

FIG. 5 and FIG. 6 are a side elevational view and a rear elevation, respectively, of the synthetic resin square bottle in a second embodiment of the invention. This bottle 1 shows another example of reinforcing method to prevent buckling of the recessed portions 12 for the bottle 1 in the above-described first embodiment. In this second embodiment, a dented reinforcing rib 14*b* is formed instead of the raised reinforcing rib 14*a* used in each recessed portion 12 of the first embodiment.

If two or more raised ribs are formed as in the case of the raised rib 13 and the raised reinforcing rib 14*a* of the first embodiment, then the fingers can be positioned definitely inside the recessed portion 12. On the other hand, users may feel bothersome in placing fingers in the recessed portions 12 because there are individual physical differences, such as the difference in finger size. In this respect, a dented reinforcing rib 14*b*, rather than the raised reinforcing rib 14*a*, allows the users to put their fingers smoothly in the recessed portions 12. Since the dented reinforcing rib 14*b* is not much effective in preventing the bottle 1 from slipping off the hand, as compared to the raised counterpart, it is preferred to leave the raised rib 13 as it is.

Figure 7:
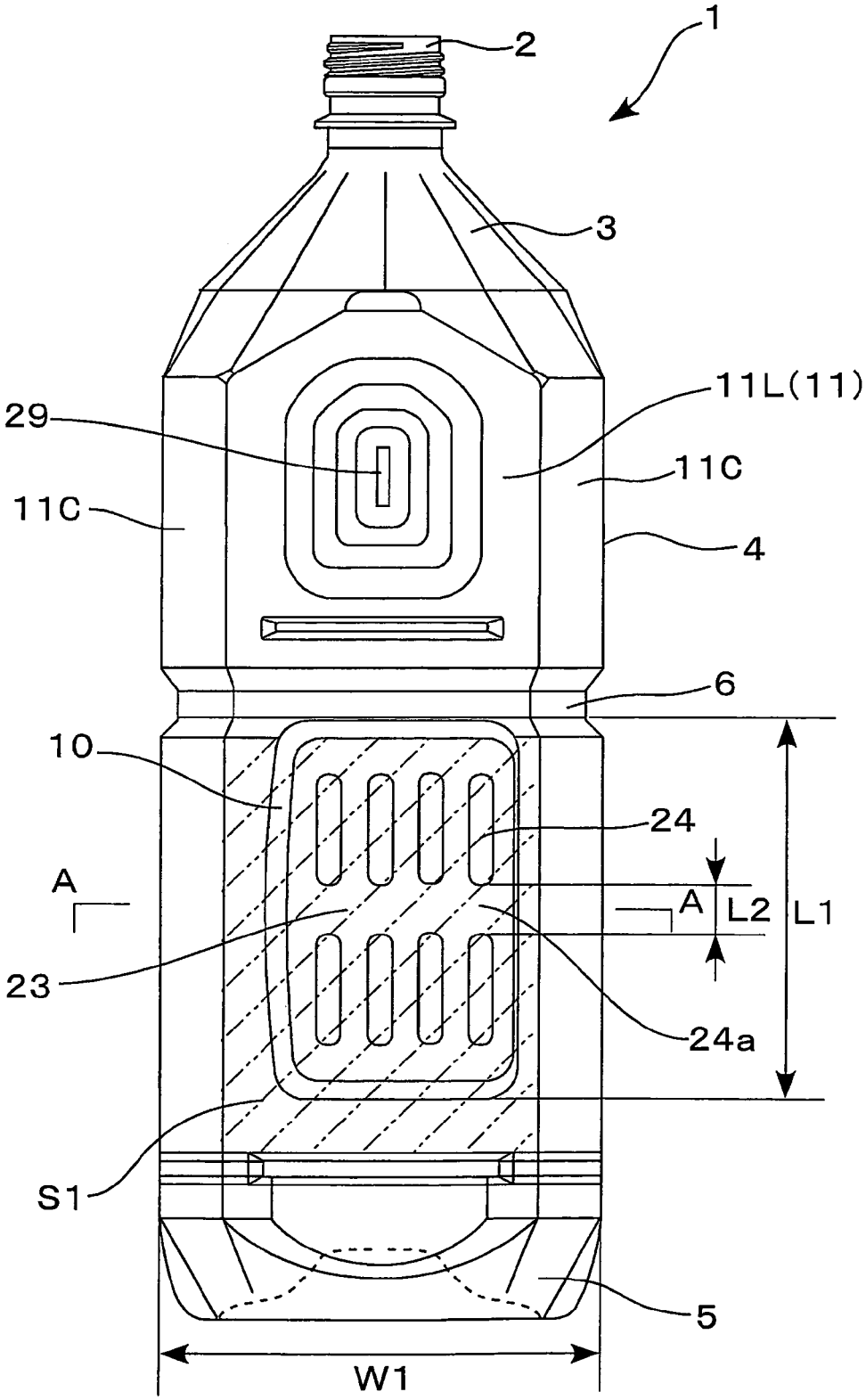
FIG. 7 is a side elevational view of the bottle in a third embodiment of this invention.
Figure 8:
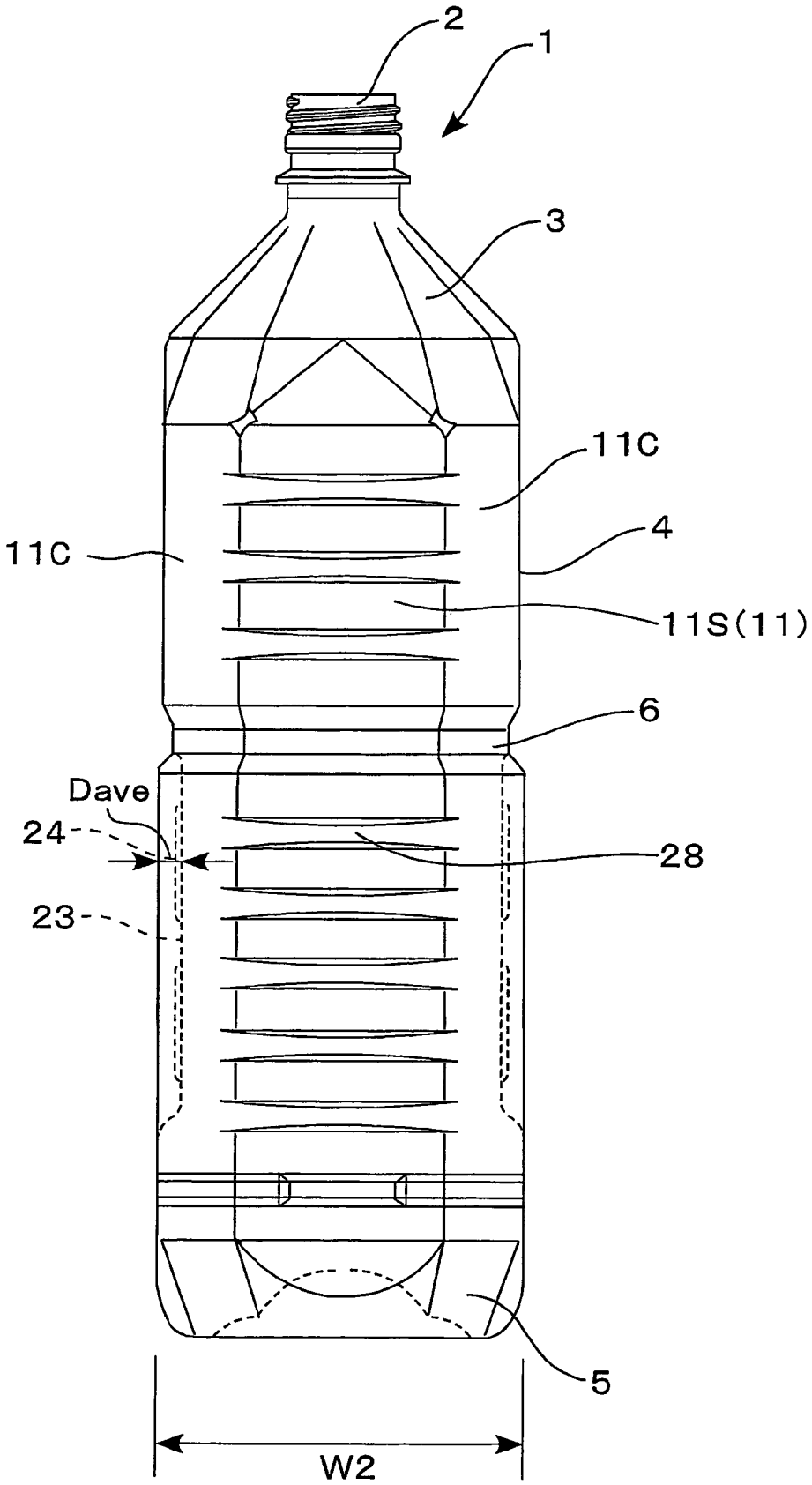
FIG. 8 is a front elevational view of the bottle shown in FIG. 7.
Figure 9:
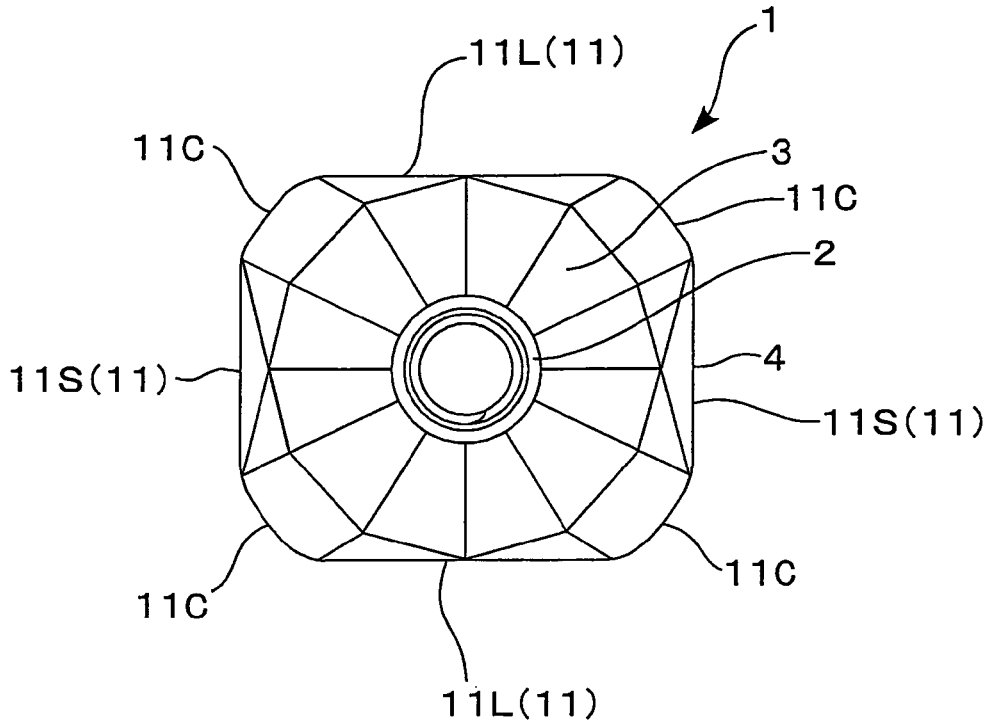
FIG. 9 is a top plan view of the bottle shown in FIG. 7.
Figure 10:
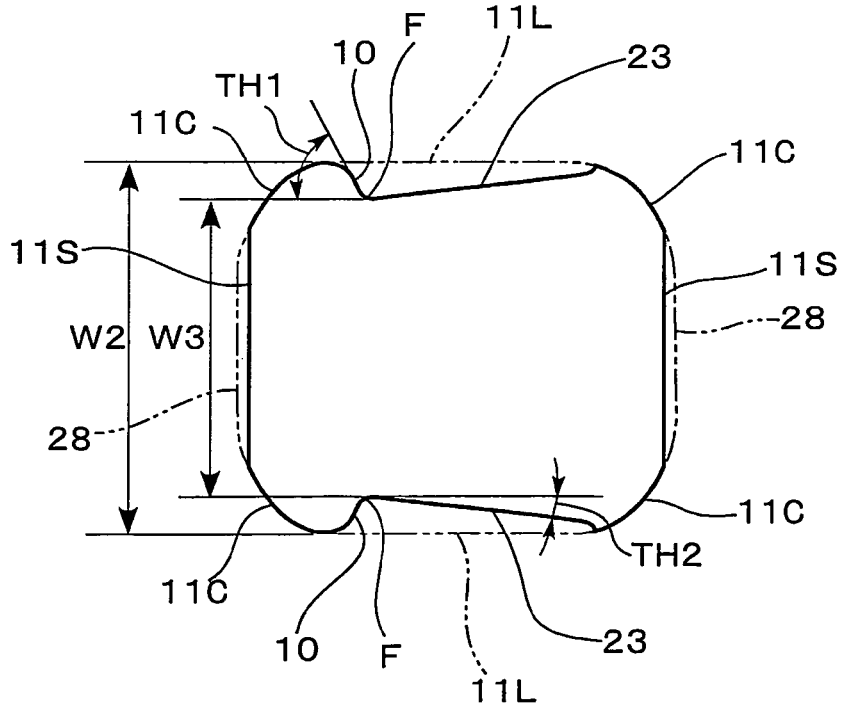
FIG. 10 is a plane cross-sectional view of the body, taken from line A-A shown in FIG. 7.
Figure 11:
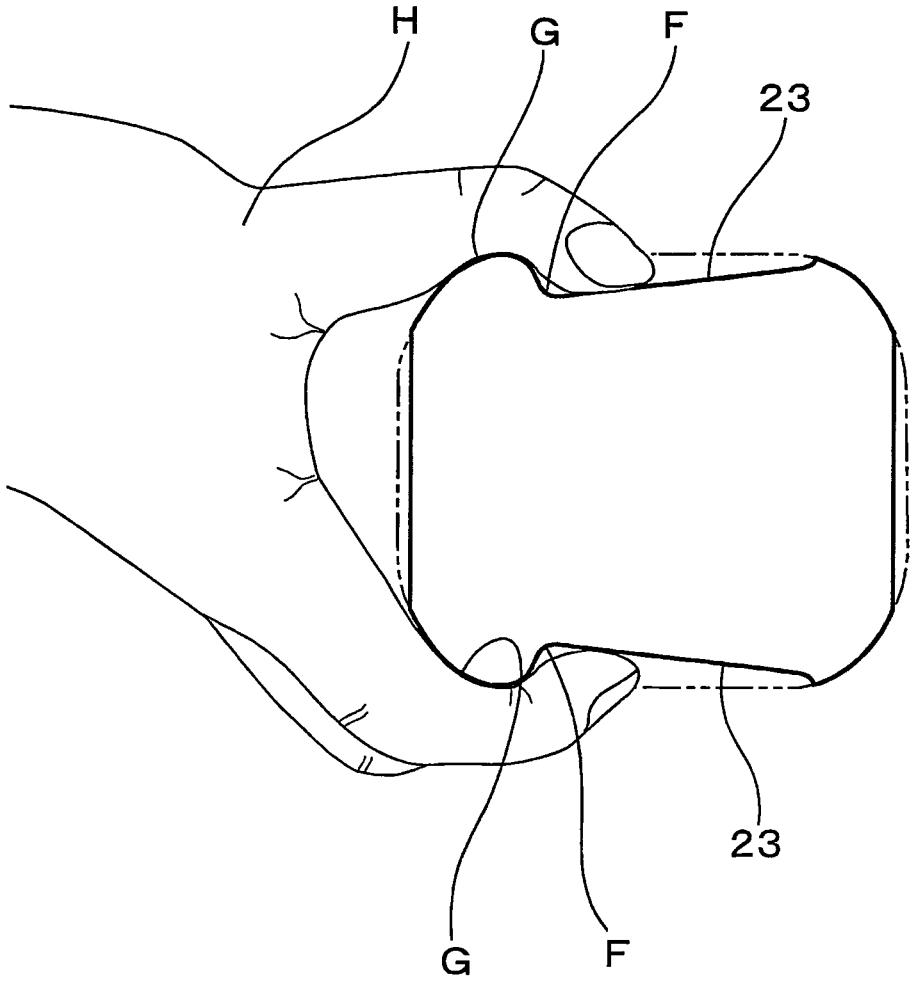
FIG. 11 is an explanatory diagram showing the bottle held with a hand in FIG. 10.

This invention is further described with respect to a preferred embodiment, now referring to the drawings. FIGS. 7-11 show the synthetic resin square bottle in a third embodiment of this invention. FIG. 7 is a side elevational view; FIG. 8, a front elevational view; FIG. 9, a plan view, and FIG. 10, a cross-sectional view taken from line A-A in FIG. 7. This bottle 1 is a biaxially drawn, blow molded product made of a PET resin, and comprises a neck 2, a shoulder 3, a body 4, and a bottom 5. It is a square bottle having a nominal capacity of 2 L. The body 4 is formed by a pair of long side walls 11L, a pair of short side walls 11S, and four corner walls 11C connecting an adjacent long side wall 11L to an adjacent short side wall 11S in a chamfered manner. As shown in FIG. 9 or 10, the plane cross-section of the body is in a rectangular shape. The body 4 is provided with a groove-like waist portion 6 at an almost middle height of the body 4 to increase the rigidity of the bottle 1.

Vacuum-absorbing panels 23 to be used also utilized as a grip are disposed below the waist portion 6 in the wide, long side walls 11L that form the long sides of the body 4, and are recessed from the long side wall 11L and surrounded by a slope 10. Ordinary vacuum-absorbing panels 29, which have been utilized conventionally, are disposed above the waist portion 6. The lower vacuum-absorbing panels 23 are available as a firm and stable grip to enable the user to get firm hold of the bottle. As shown in the following four paragraphs (1) to (4), the vacuum-absorbing panels 23 have construction associated with characteristic shapes to fulfill their action and effect.

(1) Four vertical raised ribs 24 are formed in a segmentalized state in each vacuum-absorbing panel 23.

A rib-free space 24*a* is disposed in each vertical raised ribs 24 at a middle height position.

Under this construction, the vertical raised ribs 24 help the deformation of vacuum-absorbing panels to be kept constant so that bottle appearance cannot be spoiled at the time of pressure reduction. The raised ribs 24 also provide a finger stop function for the user to hold the bottle firmly. The segments of vertical raised ribs 24, with the rib-free space 24*a* in between, allow the vacuum-absorbing panels 23 to fulfill the vacuum-absorbing function sufficiently without giving large damage to the normal cave-in deformability at the time of pressure reduction. Since the vacuum-absorbing panels 23 have relatively large areas, the user can pick out a suitable position of the grip by changing the height of the grip within the vacuum-absorbing panels, depending on the remaining volume of the contents. The number of vertical raised ribs 24 is a matter of design that can be determined appropriately, taking into account the size of bottle 1, the size of each vacuum-absorbing panel 23, and the like. The rib-free space 24*a* is not limited to a space, but can be two or more and can be determined by taking into account the balance between normal deformability at the time of pressure reduction and vacuum-absorbing property of the vacuum-absorbing panels 23.

(2) The depth of dent is increased near either right or left end of each vacuum-absorbing panel 23 (the left side in FIG. 7). The depth gradually becomes shallow toward the other end (See also FIG. 10). Under this construction, a deep dent is used as a finger stop F. By putting the thumb and fingers of a hand in the dents, the user can hold the bottle with a hand H firmly and stably, as shown in the explanatory diagram of FIG. 11. The user can also hold the body 4 of the bottle 1 firmly by grabbing the grip G with the palm of a hand. Whether the vacuum-absorbing panels 23 have a constant depth of dent or whether the depth is increased at one end can be determined by taking into account the deformability of the panels and the size and weight of the bottle 1.

(3) The vacuum-absorbing panels 23 are shifted from the horizontal center of the respective flat walls toward the right or the left (In FIG. 7, the panel 23 is a little shifted to the right.) Under the construction of this embodiment, the user would feel it easy to keep the tips of the thumb and fingers of a hand hooked to the finger stops F. The layout of vacuum-absorbing panels 23 is a matter of design. The panels 23 can be shifted to the left, or can remain at the centered position, depending on the existence or lack of finger stops F, the size of the bottle 1, and/or the size of the vacuum-absorbing panels 23. The finger stops F may not be used, and instead, the user can get hold of the bottle by putting the thumb and fingers on the vertical raised ribs 24, depending on the remaining volume of the contents and the user's posture when holding the bottle.

(4) The vacuum-absorbing panels 23 are disposed in such a way that upper edge portions are integrated with the waist portion 6. Under this construction, the user is allowed to put a part of the thumb and fingers on the slope of the waist portion 6. This prevents the bottle securely from slipping off from the hand in the vertical direction.

A multitude of lateral ribs 28 are formed in a pair of short side walls 11S that forms the short sides of a rectangular body. These ribs 28 increase the surface rigidity of the short side walls 11S especially against a compressed load in the lateral direction. Owing to these lateral ribs 28, the body 4 is prevented from getting crushed when the user holds the body 4 of the bottle 1 by using a pair of vacuum-absorbing panels 23. If the body 4 got crushed, stable gripping state would be damaged, and there would be inconvenient happenings, such as the contents bursting out of the bottle.

The square bottle in this embodiment has the following sizes, areas, and angles specified for various portions of the bottle:

Bottle height: 305 mm

Width W1 of long sides of the body: 106.5 mm: and width W2 of short sides: 90.5 mm Area S1 of a long side wall 11L below the waist portion 6 (the hatched area in FIG. 7): 7,740 $mm^2$ Area S2 of a vacuum-absorbing panel 23: 5,440 $mm^2$ Longitudinal length L1 of the vacuum-absorbing panel 23: 91.5 mm Average depth, Dave, of dents for the vacuum-absorbing panels 23: 6.3 mm Longitudinal length L2 of the rib-free space 24*a* accommodating a vertical raised rib 24: 11.5 mm Width W3 between foots of the slope 10 for forming a pair of finger stops F (See FIG. 10): 72 mm Steep slope angle TH1 of the slopes 10 for forming finger stops F (See FIG. 10): 60 degrees Gentle slope angle TH2 of the vacuum-absorbing panels 23 measured against the long side wall 11L (See FIG. 10): 7.5 degrees Among these dimensions, the bottle height and body width W1 and W2 are basic dimensions that can be determined once the capacity of a square bottle gets decided. As for other dimensions, areas, and angles can be determined by conforming to the following points (1) to (6) of design guidelines, while taking into account that the bottle 1 must maintain a good shape as a square bottle, that the necessary capacity of the bottle can be secured, and that the vacuum-absorbing panels must have a sufficient vacuum-absorbing function, must not give damage to the rigidity of bottle 1, and must also perform a function for firmly grasping the bottle:

(1) The vacuum-absorbing panels 23 have an average depth, Dave, of dents ranging from 3% to 15% of short-side width W2 of the rectangular body 4. For the bottle 1 of this embodiment, Dave is 7%;

(2) Rib-free space 24*a* between upper and lower segments of vertical raised ribs 24 has a longitudinal length L2 corresponding to 30% or less of longitudinal length L1 of each vacuum-absorbing panel 23. For the bottle 1 in the embodiment of this invention, the length L2 corresponds to 13%;

(3) Width W3 between foots of corresponding slopes 10, from which a pair of finger stops F is formed, is in a range of 50% to 90% of short-side width W2 of the rectangular body 4. For the bottle 1 of this embodiment, the width W3 corresponds to 80%;

(4) Each slope for forming a finger stop F has a steep slope angle TH1 in a range of 30 to 90 degrees. For the bottle 1 of this embodiment, the slope angle TH1 is 60 degrees;

(5) The vacuum-absorbing panels 23 have a gentle slope angle TH2 of 9 degrees or less, as measured against the long side wall 11L. For the bottle 1 of this embodiment, the slope angle TH2 is 7.5 degrees; and (6) The vacuum-absorbing panels 23 have an area (S2) in a range of 30% to 90% of area (S1) of a long side wall 11L disposed below the waist portion (6). For the bottle 1 of this embodiment, the area S2 corresponds to 70%; provided that all of these points need not necessarily be satisfied. Some of these points can be combined together to determine the shapes of various portions, taking bottle capacity and application of use into consideration.

Figure 12:
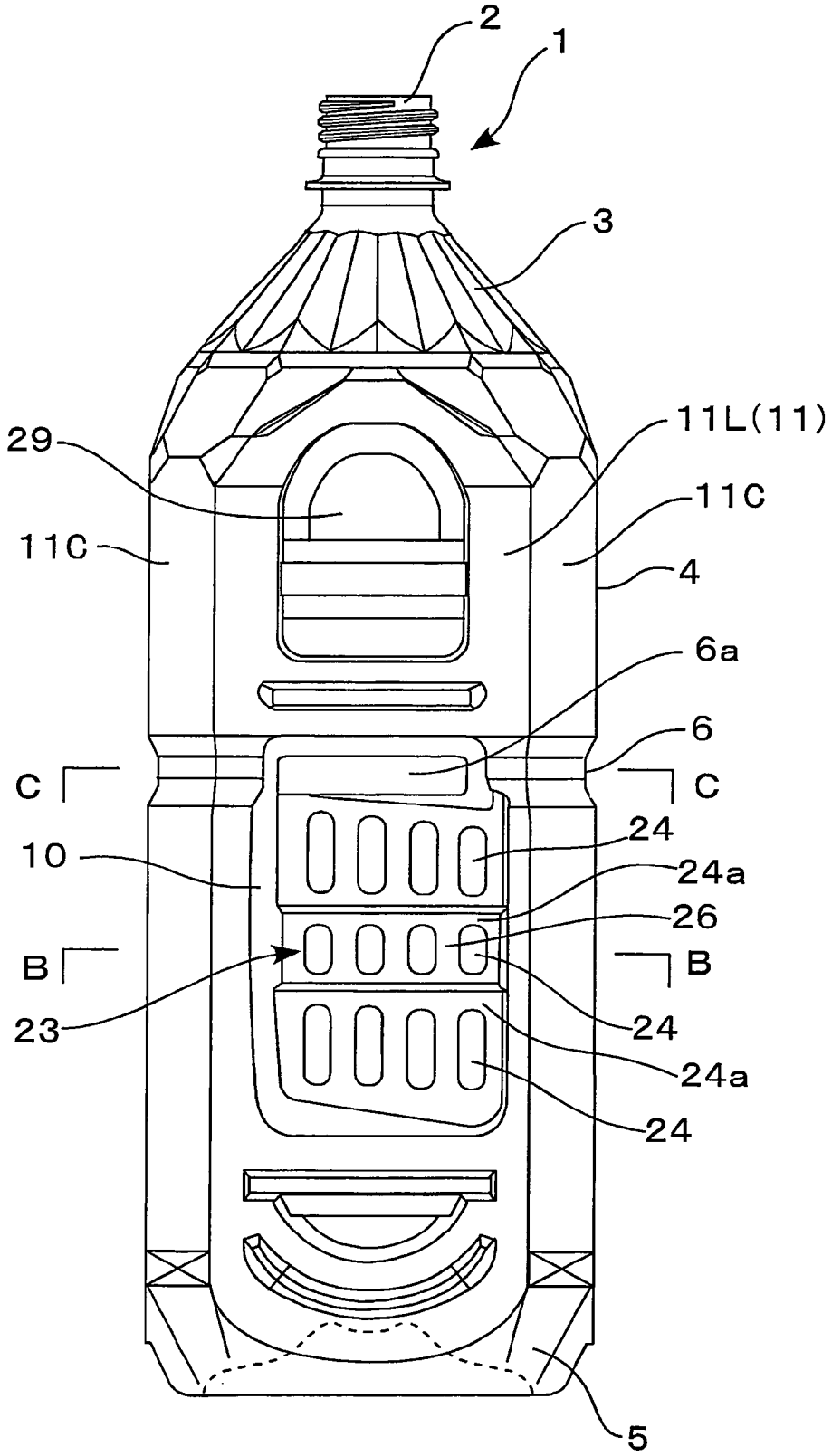
FIG. 12 is a side elevational view of the bottle in the fourth embodiment of this invention.
Figure 13:
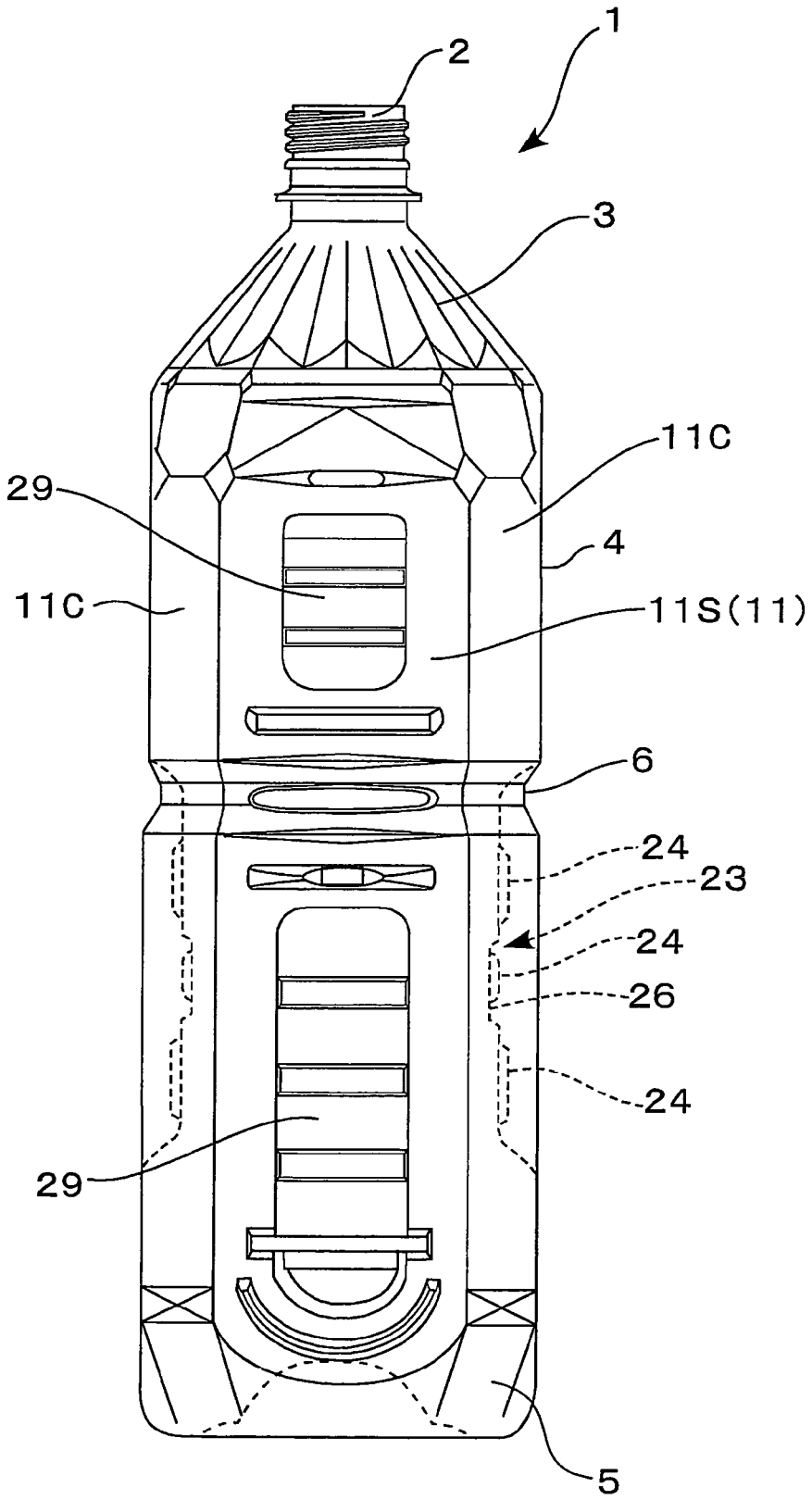
FIG. 13 is a front elevational view of the bottle of FIG. 12.
Figure 14:
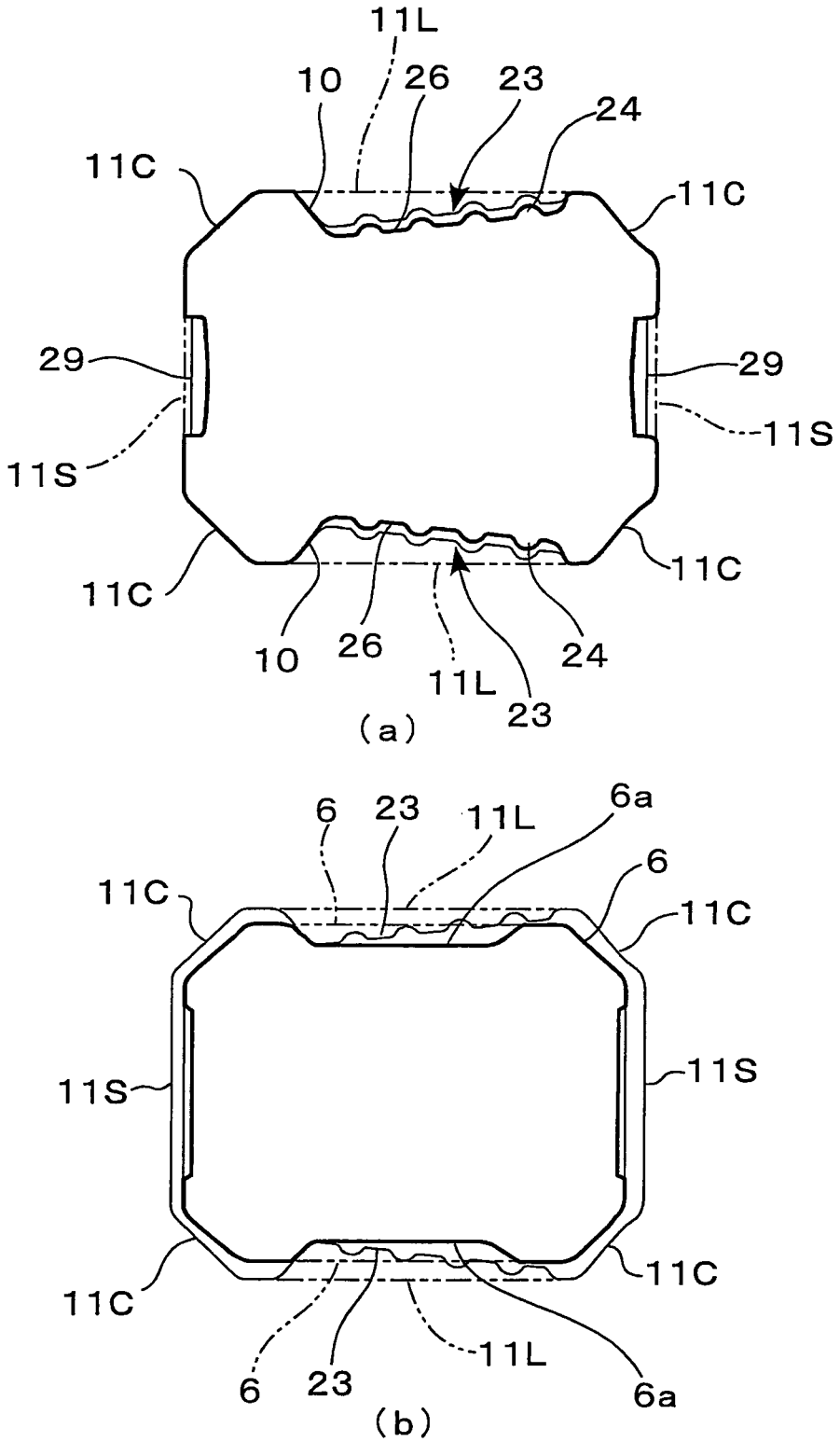
FIG. 14(*a*) is a plane cross-sectional view taken from line B-B in FIG. 12.

FIGS. 12-14 show the synthetic resin square bottle in the fourth embodiment of this invention. FIG. 12 is a side elevational view; FIG. 13, a front elevational view; FIG. 14(*a*), a plane cross-sectional view, taken from line B-B in FIG. 12; and FIG. 14(*b*), a plane cross-sectional view, taken from line C-C in FIG. 12. The bottle 1 is a biaxially drawn, blow molded PET resin product having overall shape and dimensions similar to the bottle of the third embodiment, except for the shape of vacuum-absorbing panels 23 to be used also as grips, for the shape of other ordinary vacuum-absorbing panels 29, which are disposed above the waist portion 6 in the long side walls 11L and also above and below the waist portion 6 in the short side hit walls 11S, and for the shape of the shoulder 3.

As for the vacuum-absorbing panels 23 to be used also as the grip, the bottle in the fourth embodiment is similar to the bottle of the third embodiment in that the upper edges of these panels 23 are integrated with the waist portion 6, that the panels 23 are shifted from the horizontal center, and that the finger stops F are formed by increasing the depth of dents near either right or left end (the left side in FIG. 12) and decreasing the depth gradually toward the other end. The bottle of the fourth embodiment is characterized in that a lateral recessed zone 26 for use as the finger stops is formed over the entire width of the vacuum-absorbing panels 23 at a roughly middle height position. Four segments of the vertical raised ribs 24 are disposed in the lateral recessed zone 26.

Figure 15:
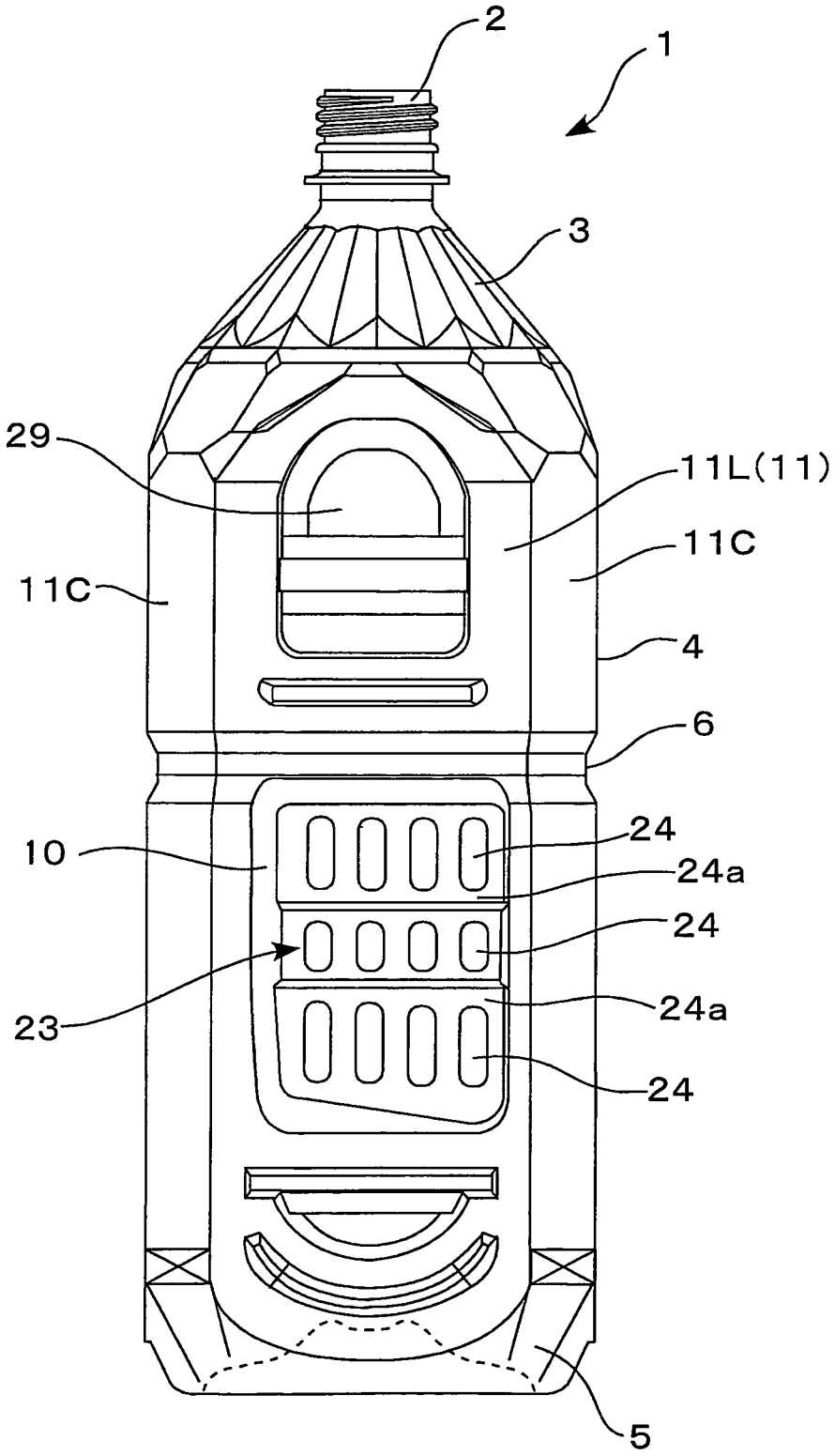
FIG. 15 is a front elevational view of a bottle shown for reference in association with the bottle of FIG. 12

The bottle of the fourth embodiment is provided with a pair of lateral deep holes 6*a* which are disposed in the upper areas of the vacuum-absorbing panels 23 and are obtained by further deepening the waist portion 6 in the lateral groove shape (See FIG. 14(*b*)). For reference, FIG. 15 is a front elevational view of a bottle having no lateral deep hole 6*a*.

In other words, the bottle 1 in the fourth embodiment of this invention has the construction characterized in that the catching effect of the finger stops is strengthened by the above-described lateral recessed zone 26 and the lateral deep holes 6*a*. The bottle in an upright, inverted, or inclined position can be held more securely and stably, for example, by putting the tip of the thumb in the waist portion integrated with one vacuum-absorbing panel 23, putting the tip of the index finger in the corresponding waist portion 6 integrated with the other vacuum-absorbing panel 23, and in addition, putting the middle finger and/or the ring finger in the lateral recessed zone 26.

This lateral recessed zone 26 prevents the vacuum-absorbing panels 23 from deforming into a swollen state, such as caused by the pressure applied at the time of filling the bottle with the contents or caused by an increase in internal pressure experienced when the contents are heated to a high temperature for the purpose of pasteurizing or simply heating the contents under a sealed condition. The width, depth, cross-sectional shape, and height of the lateral recessed zone 26 are matters of design that can be suitably determined, taking into account the gripping function, the vacuum-absorbing function, and the control effect against swelling deformation. These design matters have a variety of factors. The number of the lateral recessed zone 26 is not limited to only one, but plural zones can be formed, taking grip property into consideration.

Figure 16:
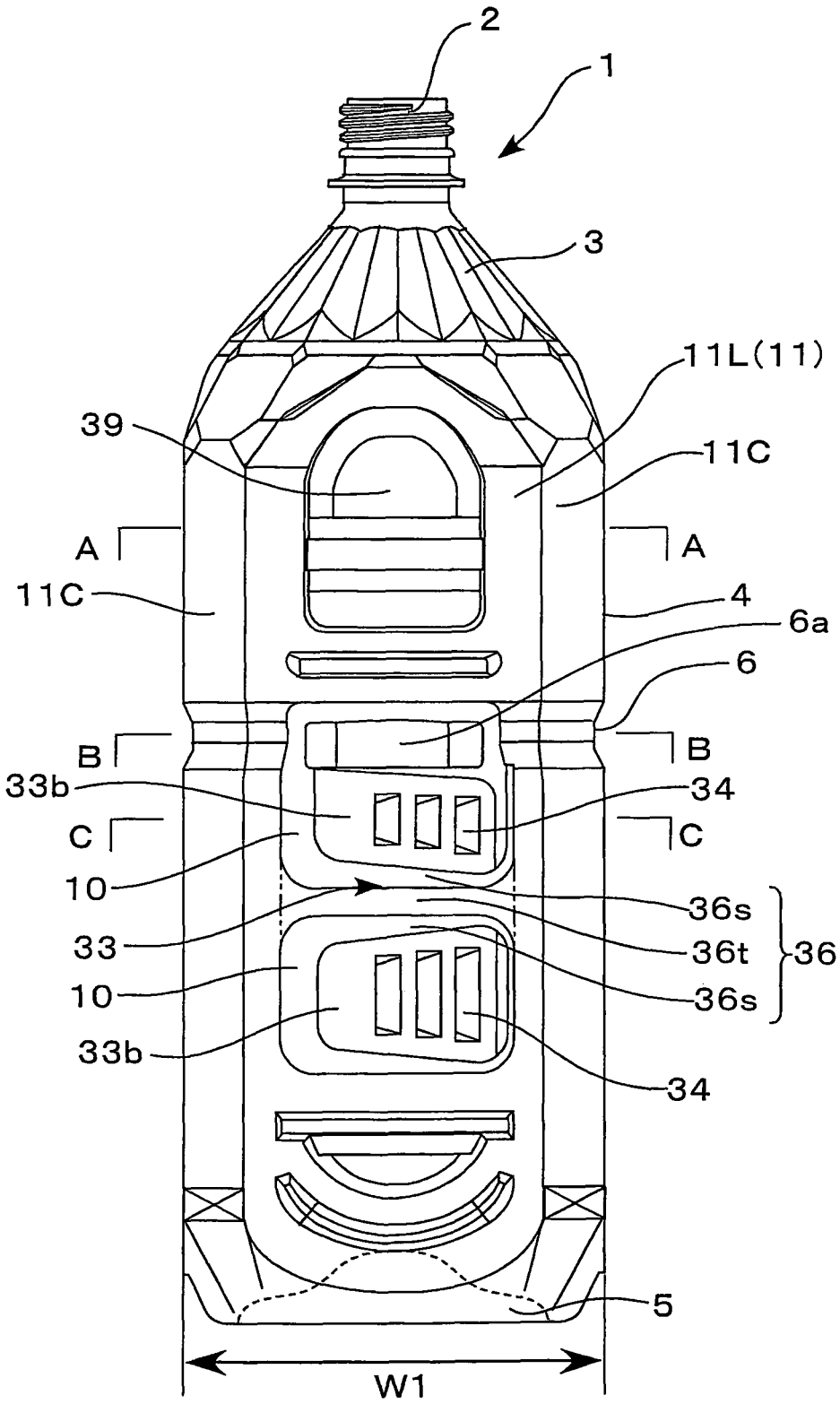
FIG. 16 is a side elevational view of the bottle in the fifth embodiment of this invention.
Figure 17:
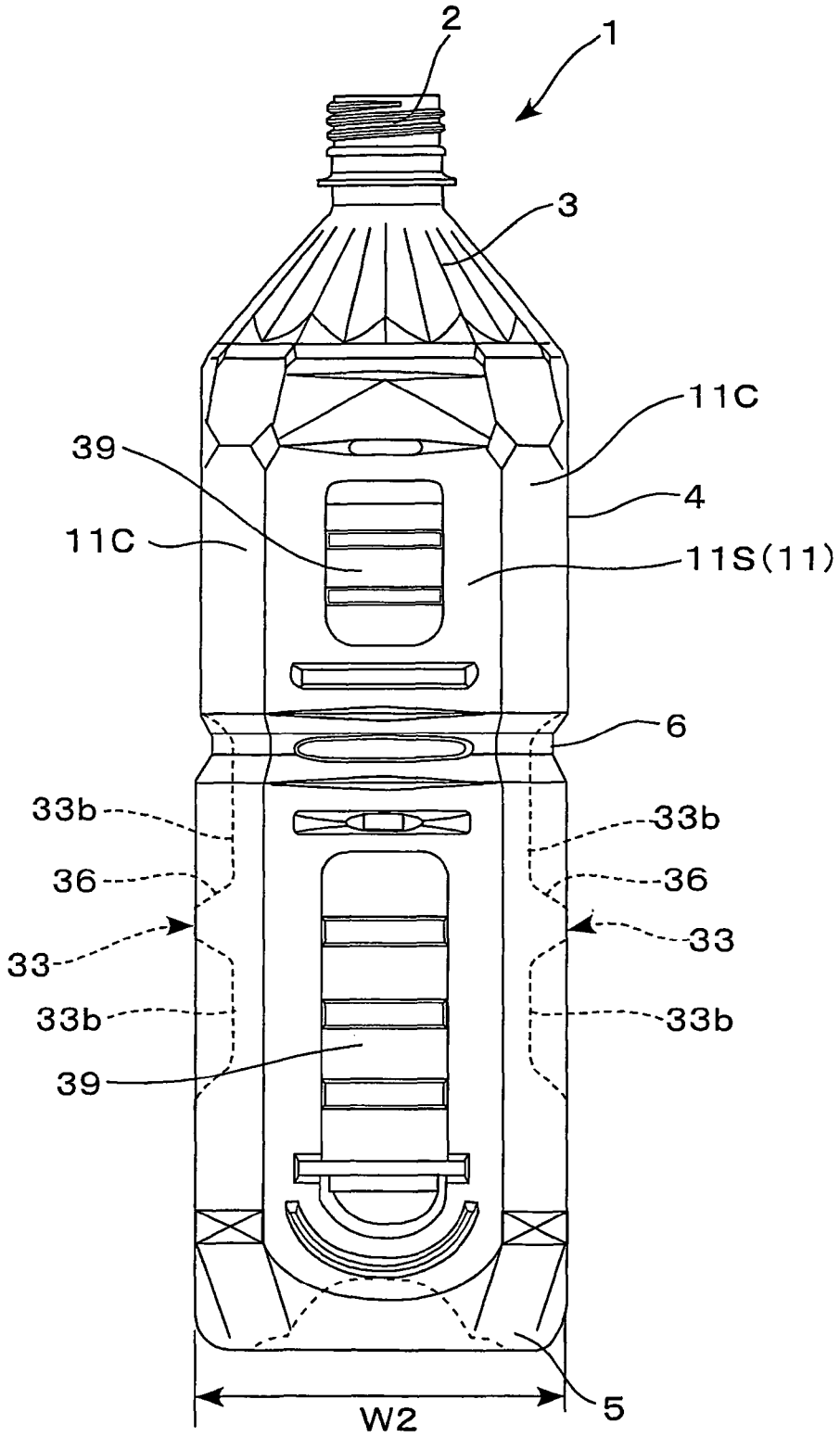
FIG. 17 is a front elevational view of the bottle shown in FIG. 16.

This invention is further described with respect to preferred embodiments, now referring to the drawings. FIGS. 16-22 show the synthetic resin square bottle in a fifth embodiment of this invention. FIG. 16 is a side elevational view; FIG. 17, a front elevational view; FIGS. 18(*a*),(*b*), plane cross-sectional views, taken from lines A-A and B-B, respectively, in FIG. 16; and FIG. 19(*a*), a plane cross-sectional view taken from line C-C and FIG. 19(*b*), an explanatory diagram showing how the body is grasped with a hand. This bottle 1 is a biaxially drawn, blow molded product made of a PET resin, and comprises a neck 2, a shoulder 3, a body 4, and a bottom 5. It is a square bottle having a nominal capacity of 2 L. The body 4 is formed by a pair of long side walls 11L, a pair of short side walls 11S, and four corner walls 11C connecting an adjacent long side wall to an adjacent short side wall 11S in a chamfered manner. As shown in FIG. 18, the plane cross-section of the body is in a rectangular shape. A waist portion 6 in the shape of a peripheral groove is formed at a middle height of the body 4 to increase the rigidity of the bottle 1.

Vacuum-absorbing panels 33 are disposed surrounding by a slope 10 below the waist portion 6 in the long side walls 11L that form the long sides of the body 4, in a state in which upper end areas of the panels 33 are integrally connected to the waist portion 6, and are also utilized as the grip together with the waist portion 6.

Ordinary vacuum-absorbing panels 39, which have been utilized conventionally, are disposed above the waist portion 6.

Figure 20:
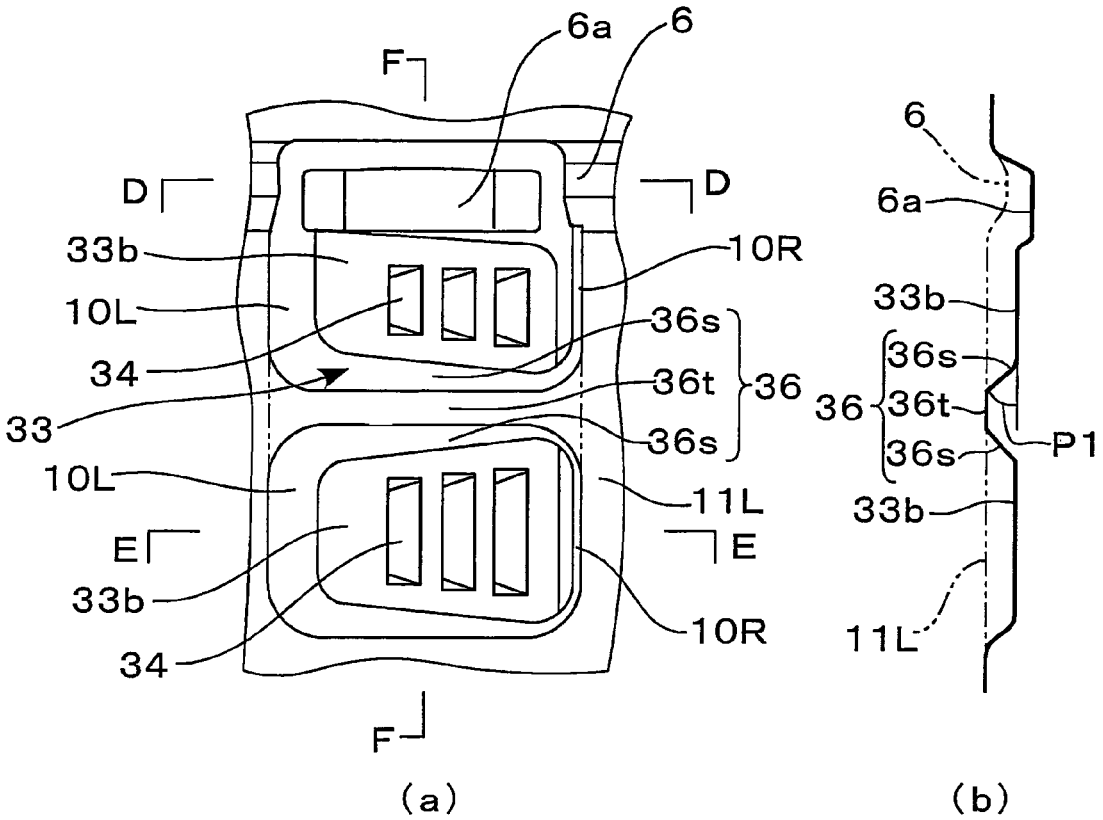
FIG. 20(*a*) is an enlarged front view of the vacuum-absorbing panel shown in FIG. 16, and FIG. 20(*b*) is a vertical section of the same panel taken from line F-F in FIG. 20(*a*).

The vacuum-absorbing panels 33, which is also utilized as the grip, are designed to ensure that the user can get steady and firm hold of the bottle 1 with a hand and to have characteristic configurations of (1), (2), and (3) and corresponding functions, as described below. FIGS. 20 and 21 are enlarged views of a vacuum-absorbing panel 33 shown in FIG. 16. FIG. 20(*a*) is an enlarged front view, and FIG. 20(*b*) is a vertical section, taken from line F-F shown in FIG. 20(*a*). FIGS. 21(*a*) and 21(*b*) are plane cross-sectional views, taken from lines D-D and E-E, respectively, shown in FIG. 20(*a*).

(1) The embanked lateral rib 36 is formed at a predetermined height position of each vacuum-absorbing panel 33 by building an embankment that rises outward from recessed surface 33*b* of the panel 33 and transversely crosses the panel 33. The embanked lateral rib 36 comprises a top flat surface 36*t* and a pair of banks 36*s* that connect this top flat surface 36*t* to the recessed surfaces 33*b* at a predetermined slope angle (50 degrees in this embodiment), and the top flat surface 36*t* is on the same plane as the long side wall 11L (See FIGS. 20(*a*) and 20(*b*)). The embanked lateral rib 36 fully functions as a lateral rib to control effectively the deformation of vacuum-absorbing panels 33 into a swollen state, which occurs with an increase in internal pressure at the time of a pressurized filling operation. Since the top flat surface 36*t* of each embanked lateral rib 36 is on the same plane as the corresponding long side wall 11L, this top flat surface 36*t* can also be utilized as a guide on the production line.

The top flat surface 36*t* is on the same plane as the long side wall 11L in this embodiment to let the embanked lateral rib 36 fully perform the function as a lateral rib. Although each vacuum-absorbing panel 33 has to be separated into upper and lower parts, the vacuum-absorbing function is performed by the entire vacuum-absorbing panel 33 including this embanked lateral rib 36.

The width, height, and cross-sectional shape of the embanked lateral rib 36, and its height position in a vacuum-absorbing panel 33 are matters of design, which can be determined suitably, by taking into consideration the function of controlling swollen deformation, the finger stop function, and the vacuum-absorbing function. These dimensions have many variations. The embanked lateral rib 36 is not limited to one for a panel, but a plural number of embanked lateral ribs 36 can be formed. It is also possible not to separate each vacuum-absorbing panel 33 into upper and lower parts. This can be done, for example, by denting the top flat surface 36*t* of the embanked lateral rib 36 only slightly from the long side wall 11L. In this case, there is a decrease in the function of controlling swollen deformation and the function as a guide described above, but the vacuum-absorbing function can be improved.

(2) As shown in FIG. 19(*a*), FIG. 19(*b*), and FIG. 21(*b*), the slope 10L is long and steep at either right or left end of each vacuum-absorbing panel 33 (on the left end in these figures). At the other end, the slope 10R is gentle and short. Thus, the depth of each recessed surface 33*b* becomes shallow linearly from left to right. The recessed surfaces 33*b* of each vacuum-absorbing panel 33 are provided with ridge segments 34 having an anti-slip function to prevent slips in the lateral direction.

As described above, the slope 10L is long and steep at the left end of each vacuum-absorbing panel 33. The user can get firm hold of the bottle 1 with the palm of a hand by fixing fingers to the finger stop F at one end of the vacuum-absorbing panel 33 where the dent has been deepened, as shown in the explanatory diagram of FIG. 19(*b*). The user can also grasp the grip G in FIG. 19(*b*) with the palm of a hand to get hold of the bottle 1 more steadily. In the case of grasp as shown in FIG. 19(*b*), the width is smallest between a pair of recessed surfaces 33*b* on the sides where the body is grasped with fingers, as the wall portions comprising the vacuum-absorbing panels 33 are tapered from the right to the left. In such a case, fingers are prone to sideslip to the right. The ridge segments 34 projected from the recessed surfaces 33*b* are effective in stopping the sideslip.

(3) The upper end areas of the vacuum-absorbing panels 33 are integrated with the waist portion 6. The groove-like waist portion 6 is further caved in to form lateral deep holes 6*a* for the finger stop use (See FIG. 18(*b*), FIG. 20(*a*), FIG. 20(*b*), and FIG. 21(*a*)). Under this construction, the user can put a part of fingers in the lateral deep holes 6*a* of the waist portion 6 and the bottle 1 is prevented from slipping off vertically.

FIG. 19(*b*) shows a standard example of grasping the bottle 1 of this embodiment. The user fits the tip of the thumb in the lateral deep hole 6*a* that has been integrated with the waist portion 6 of one long side wall 11L, and puts the tip of the index finger in the corresponding lateral deep hole 6*a* disposed in the other long side wall 11L. In addition, the user puts the middle finger in the area upside of the embanked lateral rib 36, and puts the ring finger and the little finger in the area underside of the embanked lateral rib 36 of the vacuum-absorbing panel 33 disposed in the other long side wall 11L, while utilizing the banks 36*s* of the embanked lateral rib 36 as finger stops. In this manner, the bottle in various positions, including an upright, inverted, or inclined position, can be held more securely and stably than ever.

Of course, the way to grasp the bottle 1 is not limitative and has many variations, depending on the users and the remaining volume of the contents. FIG. 19(*b*) shows the bottle held by utilizing finger stops F from the left side, but if the users utilize the locking function of the embanked lateral ribs 36, they can grasp the bottle with a certain level of steadiness, without paying attention to the grasping direction or the height position. Depending on the side width of the body 4 and the size of the palm, the user may grasp the bottle better from the right side.

The square bottle of this embodiment has the following sizes, areas, and angles specified for various portions of the bottle:

Bottle height: 303 mm

Lateral long-side width, W1, of the body 4: 106 mm: and short-side width, W2: 90 mm Depth of recessed surface of each vacuum-absorbing panel 13: 6.1 mm Width, W3 between foots of the slope 10L from which a pair of finger stops, F, is formed (See FIG. 19(*a*)): 72 mm Steep rising slope angle, TH, of each slope 10 used as a finger stop, F (See FIG. 19(*a*)): 60 degrees Among these dimensions, the bottle height and width, W1 and W2, of the body are the basic dimensions that can be determined once the capacity of a square bottle gets decided. Other dimensions, areas, and angles can be determined by conforming to the following points (1) to (3) of design guidelines, while taking into account that the bottle 1 must maintain a good shape as a square bottle, that the necessary capacity of the bottle can be secured, and that the vacuum-absorbing panels 33 must have a sufficient vacuum-absorbing function, must not give damage to the rigidity of the bottle 1, and must also fully perform a function for firmly grasping the bottle 1:

(1) The vacuum-absorbing panels 33 have an average depth of dents ranging from 3% to 15% of short-side width W2 of the rectangular body 4. For the bottle 1 of this embodiment, the depth is 6.8%;

(2) Width W3 between foots of corresponding slopes 10L, from which a pair of finger stops F is formed, is in a range of 60% to 95% of short-side width W2 of the rectangular body 4. For the bottle 1 of this embodiment, the width W3 corresponds to 80%; and (3) Each slope 10L for forming a finger stop F has a steep slope angle TH1 in a range of 30 to 90 degrees. For the bottle 1 of this embodiment, the slope angle TH1 is 60 degrees;

provided that all these points need not necessarily be satisfied. Some of these points can be combined together to determine the shapes of various portions, taking bottle capacity and application of use into consideration.

Figure 22:
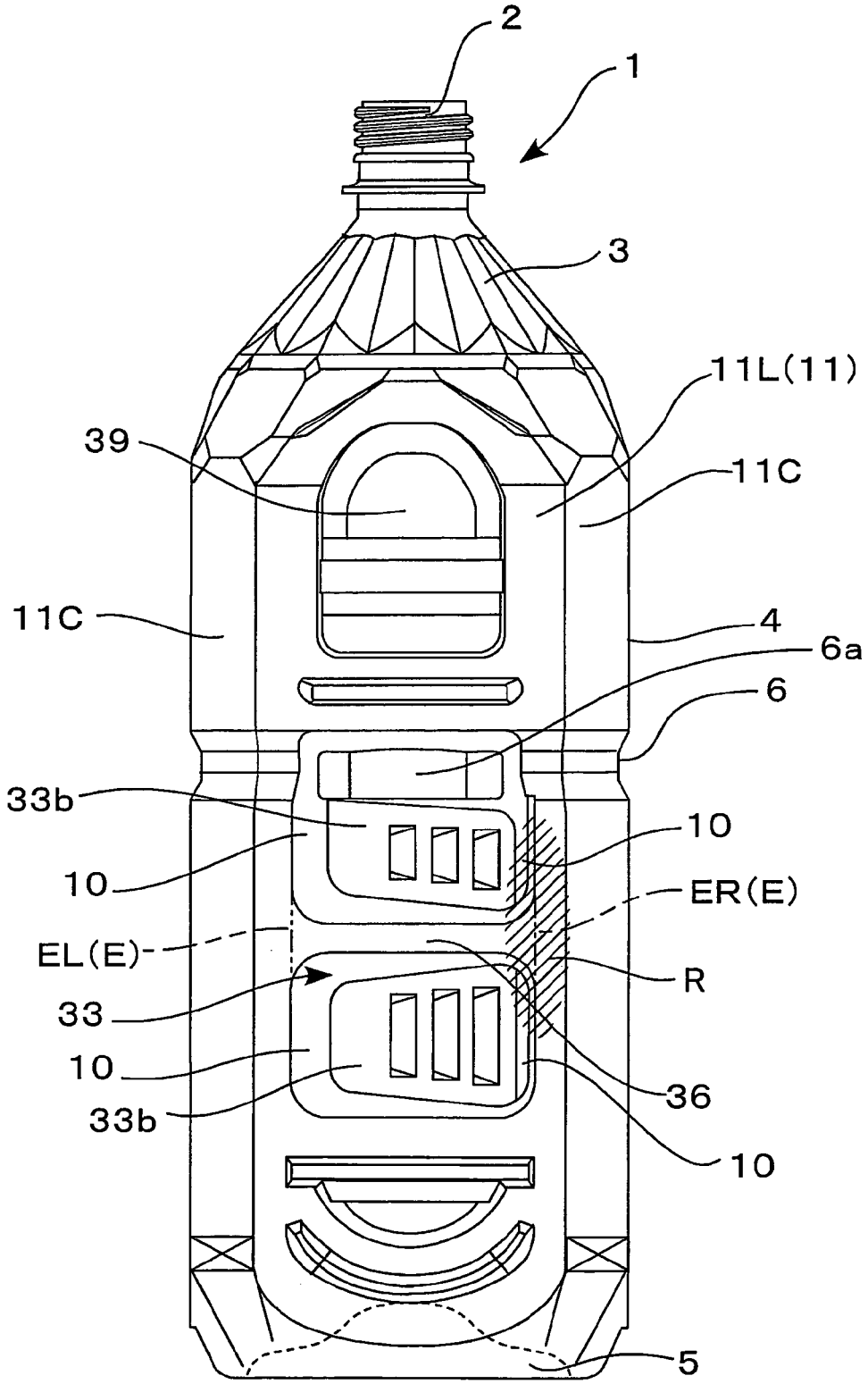
FIG. 22 is the same front elevational view as FIG. 16 and is an explanatory diagram showing the area to be dented at the time of depressurization.

The above bottle of the fifth embodiment is further described as to its behavior at the time of deformation into a dented state, as experienced when there is an increase in depressurization inside the bottle, while referring to FIG. 22. Both ends E of the embanked lateral rib 36 are where this rib 36 butts, in a T-shaped configuration, against the panel-surrounding slope 10 on both right and left sides of the recessed surfaces 33*b* of each vacuum-absorbing panel 33. At the rib end ER on the shallow side of the recessed surface 33*b* (the right side in FIG. 22), both the slope 10 and the embanked lateral rib 36 are low in height, and therefore, this rib end ER is prone to inflection and deformation into a dented state.

When the bottle is put under reduced pressure, at first the entire body wall is affected by deformation caused by reduced volume of the bottle. Then, if depressurization is further increased, the rib end ER having above configuration is preferentially inflected along the chain double-dashed line shown in FIG. 22, and is deformed into a dented state. The deformation starting from this inflected rib end ER is carried forward to a surrounding area R (the hatched area in FIG. 22).

The deformation showing the above-described behavior is a type of deformation in which the entire vacuum-absorbing panel 33, along with the embanked lateral rib 36, is pushed inward as if a door is forcibly pushed inward, with the rib end EL on the deep side of the recessed surface acting as a fixed end (an axis). The internal volume of the bottle 1 can be effectively decreased in this manner. And despite a considerable decrease in the internal volume, the bottle appearance is not damaged to a large extent, and a very good vacuum-absorbing function is performed even if the deformation is carried forward from the shallow-side rib end ER to the surrounding area. This is because the embanked lateral rib 36 and the slope 10 near this rib end ER are made low in height.

In the case of the above-described bottle of the fifth embodiment, the end ER of the embanked lateral rib 36 on the shallow side is prone to inflection and deformation into a dented state. Thus, when the user gets hold of the body 4 by putting fingertips on the vacuum-absorbing panels 33, the rib end ER is preferentially inflected and dented, and such deformation starting from this rib end ER is smoothly carried forward to the surrounding area. The deformation into the dented state that proceeds in the above-described manner is enough to decrease the internal volume substantially and to effectively protect other portions of the bottle against any distorted deformation into a dented state.

If the user happens to grasp the body 4 from the right side of the bottle, the rib end ER is preferentially inflected and deformed into a dented state, and the deformation starting from this inflected rib end ER is carried forward to the surrounding area R. Since the embanked lateral rib 36, a nearby slope 10, and an adjacent long side wall portion 11L are deformed in the above-described manner by the squeeze with the fingers in contact with respective portions, the body of the bottle well fits in with the palm of the hand with which the bottle is held.

FIG. 23(*a*) is an enlarged front view of the vacuum-absorbing panel 33 in the sixth embodiment, and FIGS. 23(*b*) and 23(*c*) are vertical sections of important parts thereof, used for the synthetic resin square bottle in the sixth embodiment of this invention. FIGS. 24(*a*) and 24(*b*) are plane cross-sectional views of important parts in the vacuum-absorbing panel 33. The bottle in the sixth embodiment shows a variation in the shape of the vacuum-absorbing panel 33 from the bottle in the fifth embodiment described above. FIG. 23(*a*) is an enlarged front view of the vacuum-absorbing panel 33; FIG. 23(*b*), a vertical section taken from line I-I in FIG. 23(*a*); and FIG. 23(*c*), a vertical section taken from line J-J in FIG. 23(*a*). FIGS. 24(*a*) and 24(*b*) are plane cross-sectional views taken from lines G-G and H-H, respectively, in FIG. 23(*a*).

Since it is intended in the bottle of this invention that the vacuum-absorbing panels 33 are also utilized as the grip, the slopes 10 are formed so as to reach a relatively large depth. Because of this depth, it is relatively difficult to carry forward the deformation smoothly to a nearby long side wall 11L when the vacuum-absorbing panels 33 is deformed into a dented state due to a decrease in the contents of the bottle 1 under reduced pressure. Reversed buckling deformation tends to occur especially in areas ranging from the long side walls 11L on the shallow sides of the vacuum-absorbing panels 33 to the corresponding corner walls 11C. With the vacuum-absorbing panel 33 shown in FIGS. 23 and 24, it is intended to prevent buckling deformation caused by an increase in decompression, by allowing the vacuum-absorbing function of the panel 33 to be performed more effectively.

The configuration of the vacuum-absorbing panels 33 used in the bottle 1 of the sixth embodiment is characterized by the following three points (1), (2), and (3):

(1) The right slope 10R has a height h2 as low as 1.5 mm and a rising slope angle of 43 degrees (See FIG. 24(*b*)). In the case of the vacuum-absorbing panel 33 used in the fifth embodiment, the slope 10R has a height h1 of 3 mm and a rising slope angle of 62 degrees (See FIG. 21(*b*));

(2) The banks 36*s* of the embanked lateral rib 36 have a rising slope angle of 57 degrees on the left side of the vacuum-absorbing panel 33. This angle is gradually decreased to 18 degrees from the left toward the right of the panel 33 (See the angles P2 and P3 in FIGS. 23(*b*) and 23(*c*)). By comparison, in the case of the vacuum-absorbing panel 33 used in the fifth embodiment, the banks 36*s* have a constant slope angle P1 of 50 degrees (See FIG. 20(*b*)); and (3) A crescent-shaped ridge 38 is formed by folding each bank 36*s* at the corner 37 of the bank 36*s* and the slope 10R (See FIGS. 23(*a*) and 23(*c*)).

When the action and effect of the above constructive requirements (1), (2), and (3) are correlatively at work, the deformation of the vacuum-absorbing panels 33 into a dented state, as caused by a decrease in the contents of the bottle 1 under reduced pressure, can be smoothly carried forward to adjacent long side walls 11L by way of the slope 10 on the right side of the panel 33. As a result, the vacuum-absorbing function of the panel 33 can be performed more effectively.

More particularly, when the vacuum-absorbing panels 33 is deformed into a dented state due to a decrease in the contents of the bottle 1 under reduced pressure, this deformation is carried forward smoothly to the long side wall 11L disposed next to the slope 10R, by way of this slope 10R on the right side of the panel 33, where the slope is low in height and angle. Thus, under the constructive requirement (1), the vacuum-absorbing function can be effectively performed. According to the constructive requirement (2), the banks 36*s* at the right end have a small rising slope angle and are low in height. Therefore, the deforming force can be smoothly carried forward from the corner 37 to the long side wall 11L, thus effectively preventing the buckling deformation from occurring at or near this corner 37. According to the constructive requirement (3), the crescent-shaped ridge 38 at the corner 37 is stretched so that the action and effect of (2), above, can be reliably achieved.

This invention has bee described with respect to preferred embodiments and their action and effects. However, this invention should not be construed as limitative to these embodiments. For example, this invention can be applied to the bottles made of synthetic resins other than the PET resin. Furthermore, this invention is not limited to the bottle with a capacity of 2 L, but can be applied to the bottles of a larger size than 2 L, while making it easy for the user to get firm hold of the bottle.

There are many variations in the shape of the lateral deep hole associated with the grip of this invention and in the position in which this lateral deep hole is formed. In the case of the bottle larger than 2 L, a good grip can be secured by shifting the position of lateral deep holes toward the rear of the bottle. The above embodiments have been described by taking an example of vacuum-absorbing panels that are integrally connected to the waist portion. However, the vacuum-absorbing panels for use as a grip can also be separated from the waist portion.

INDUSTRIAL APPLICABILITY

As obvious from the foregoing description, it is ensured that a large size square bottle of this invention is provided with drastically strengthened grip. And this can be done by utilizing the vacuum-absorbing panels as the grip, without giving damage to bottle appearance. As such, wide applications of use are expected especially in the field of large-size square bottles.

The invention claimed is:

1. A synthetic resin bottle comprising a body having a rectangular shape in a plane cross-section and a waist portion disposed at a middle height of the bottle, forming a circumferential groove so as to divide each side wall into an upper side wall and a lower side wall;

wherein a pair of vertically long recessed portions for use as finger stops are formed in respective long side walls of said rectangular body over a predetermined continuous area ranging from said waist portion downward to ensure that a plural number of fingers can be placed in at least one vertically long recessed portion for a finger stop purpose;

a grip for holding the bottle is formed from both the pair of vertically long recessed portions and a side wall that connects the pair of vertically long recessed portions;

vacuum-absorbing panels are formed to be surrounded by a slope in the vertically long recessed portions for use as finger stops;

wherein the depth of recessed surfaces of the vacuum-absorbing panels is decreased gradually from either a right or a left end toward an other end;

wherein an embanked lateral rib is formed at a predetermined height position of each vacuum-absorbing panels by building an embankment that rises outward from a recessed surface of the panel and transversely crosses the panel;

wherein the embanked lateral rib comprises a top flat surface and a pair of banks that connect this top flat surface to the recessed surfaces at a predetermined slope angle and;

wherein the top flat surface is on the same plane as the long side wall.

2. The synthetic resin bottle according to claim 1, wherein the vacuum-absorbing panels are disposed in such a way that upper end areas thereof are integrally connected to the waist portion.

3. The synthetic resin bottle according to claim 2, wherein the lateral groove of the waist portion is further caved inward at areas connected to the vacuum-absorbing panels to form lateral deep holes for use as finger stops.

4. The synthetic resin bottle according to claim 1, wherein dented vacuum-absorbing panels have an average depth of dents ranging from 3% to 15% of short-side width of the rectangular body.

5. The synthetic resin bottle according to claim 1, wherein a finger stop is formed by increasing a depth of a dent at or near either a right or a left end of each vacuum-absorbing panel.

6. The synthetic resin bottle according to claim 5, wherein a width between foots of corresponding slopes, from which a pair of finger stops is formed, is in a range of 60% to 95% of a short-side width of the rectangular body, and wherein each slope used as a finger stop has a steep rising slope angle in a range of 30 to 90 degrees.

7. The synthetic resin bottle according to claim 1, wherein the embanked lateral rib comprises the top flat surface and the pair of banks that connect this top flat surface to the recessed surfaces, wherein the top flat surface is on a same plane as the long side wall, and wherein an angle of gradient of the pair of banks is gradually changed from either the right or the left end of a vacuum-absorbing panel, where the depth of dent is largest, to an other shallow end so as to give the shallow end a low angle of gradient.

8. The synthetic resin bottle according to claim 1, wherein a deformation of the vacuum-absorbing panels into a dented state, which occurs at a time of increased depressurization inside the bottle, is carried forward in a recoverable manner to a surrounding area, starting from the deformation at either the right or the left end of the embanked lateral rib disposed on the shallow side of the recessed surface of each vacuum-absorbing panel.

9. The synthetic resin bottle according to claim 1, wherein, at a time when a user gets hold of the body by putting a thumb and fingers on the vacuum-absorbing panels so as to squeeze the body, a resultant deformation of the vacuum-absorbing panels into a dented state is carried forward in a recoverable manner to a surrounding area, starting from deformation at either a right or a left end of the embanked lateral rib disposed on the shallow side of the recessed surface of each vacuum-absorbing panel.

10. The synthetic resin bottle according to claim 1, wherein the recessed surfaces of the vacuum-absorbing panels are provided with ridge segments having an anti-slip function to prevent slips in the lateral direction.

* * * * *

UNITED STATES PATENT AND TRADEMARK OFFICE

CERTIFICATE OF CORRECTION

PATENT NO. : 8,739,995 B2
APPLICATION NO. : 11/990980
DATED : June 3, 2014
INVENTOR(S) : Masaaki Sasaki et al.

It is certified that error appears in the above-identified patent and that said Letters Patent is hereby corrected as shown below:

In the Specification

Correct column 9, line 22 to recite:

"The means of carrying out the 34$^{th}$ invention comprises..."

Signed and Sealed this
Nineteenth Day of August, 2014

Michelle K. Lee

Michelle K. Lee
*Deputy Director of the United States Patent and Trademark Office*